US010716982B2

(12) United States Patent
Bruce et al.

(10) Patent No.: US 10,716,982 B2
(45) Date of Patent: Jul. 21, 2020

(54) SYSTEMS AND METHODS FOR AN ADJUSTABLE STRAP SYSTEM FOR A GOLF BAG

(71) Applicant: KARSTEN MANUFACTURING CORPORATION, Phoenix, AZ (US)

(72) Inventors: Ryan Bruce, Phoenix, AZ (US); John Loudenslager, Austin, TX (US); James Martell, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/659,390

(22) Filed: Oct. 21, 2019

(65) Prior Publication Data

US 2020/0047039 A1 Feb. 13, 2020

Related U.S. Application Data

(63) Continuation of application No. 15/724,168, filed on Oct. 3, 2017, now Pat. No. 10,449,429.

(60) Provisional application No. 62/403,570, filed on Oct. 3, 2016.

(51) Int. Cl.
*A63B 55/40* (2015.01)
*A63B 55/00* (2015.01)

(52) U.S. Cl.
CPC ..... *A63B 55/408* (2015.10); *A63B 55/40* (2015.10)

(58) Field of Classification Search
CPC ..... A45F 3/047; A45F 2003/142; A45F 2003/148; A63B 55/408; A63B 55/40
USPC ..... 224/264, 607, 627, 631, 643, 645
See application file for complete search history.

(56) References Cited

U.S. PATENT DOCUMENTS

| | | | | |
|---|---|---|---|---|
| 83,387 | A | 10/1868 | Jennings | |
| 117,694 | A * | 8/1871 | Smith | A41F 3/00 24/315 |
| 1,213,386 | A | 1/1917 | Lamothe | |
| 1,288,170 | A | 12/1918 | Pick | |
| 1,501,066 | A | 7/1924 | Rutherford | |
| 1,697,363 | A | 1/1929 | Losey | |
| 1,855,007 | A | 4/1932 | Ambrose | |

(Continued)

FOREIGN PATENT DOCUMENTS

| | | |
|---|---|---|
| EP | 065067 | 5/1995 |
| JP | S58192933 | 12/1983 |

(Continued)

OTHER PUBLICATIONS

International Search Report for Application No. GB1209210.2 dated Jul. 2, 2012.

*Primary Examiner* — Corey N Skurdal

(57) ABSTRACT

Embodiments of bag having an adjustable carrying strap system and methods to manufacture such a bag are generally described herein. In some embodiments, the adjustable carrying strap system includes a plurality of carrying straps configured to be coupled to a bag at one end and a connector plate at the opposite end thereof to provide a self-centering capability to the bag, such as a golf bag. The connector plate comprises an arc region and an apex region opposite the arc region and defines a first arc slot and a second arc slot in the arc region and a first straight slot and a second straight slot within the apex region. In some embodiments, the connector plate defines a center slot defined between the first and second arc slots and the first and second straight slots.

12 Claims, 19 Drawing Sheets

(56) References Cited

U.S. PATENT DOCUMENTS

| | | | | |
|---|---|---|---|---|
| 2,835,010 | A | 5/1958 | Bayon | |
| 3,739,961 | A * | 6/1973 | Soukeras | A45C 1/04 224/579 |
| 4,236,755 | A | 12/1980 | Pollitt et al. | |
| 4,757,927 | A | 7/1988 | Rutty | |
| 4,764,962 | A | 8/1988 | Ekman et al. | |
| D313,343 | S | 1/1991 | Sachs | |
| 5,016,797 | A | 5/1991 | Rowledge | |
| 5,038,984 | A | 8/1991 | Izzo | |
| 5,042,703 | A | 8/1991 | Izzo | |
| 5,042,704 | A | 8/1991 | Izzo | |
| 5,241,614 | A | 8/1993 | Ecker et al. | |
| 5,421,614 | A | 6/1995 | Zheng | |
| 5,490,620 | A | 2/1996 | Bergqvist | |
| 5,593,077 | A | 1/1997 | Izzo | |
| D411,039 | S | 6/1999 | Reimers et al. | |
| D411,666 | S | 6/1999 | Reimers et al. | |
| D412,396 | S | 8/1999 | Reimers et al. | |
| D413,019 | S | 8/1999 | Reimers | |
| 6,006,974 | A | 12/1999 | Varney et al. | |
| 6,152,342 | A * | 11/2000 | Suk | A63B 55/408 224/259 |
| 6,305,535 | B1 | 10/2001 | Fair | |
| 6,530,129 | B1 * | 3/2003 | Cheng | A45F 3/14 24/200 |
| 7,131,534 | B2 | 11/2006 | Enes | |
| 7,318,542 | B2 | 1/2008 | Godshaw et al. | |
| 7,387,226 | B2 | 6/2008 | Porter | |
| 7,704,588 | B1 * | 4/2010 | Mrofka | B65D 63/16 24/16 R |
| 7,857,181 | B2 | 12/2010 | Sacks | |
| 8,256,610 | B2 * | 9/2012 | Michas | A45F 3/04 206/315.7 |
| 9,386,807 | B2 * | 7/2016 | Dalton | A41F 15/02 |
| 2007/0278264 | A1 | 12/2007 | Chesal et al. | |
| 2010/0170065 | A1 | 7/2010 | Paik | |

FOREIGN PATENT DOCUMENTS

| | | |
|---|---|---|
| JP | H11164723 | 6/1999 |
| WO | 2005030001 | 4/2005 |

* cited by examiner

SYSTEMS AND METHODS FOR AN ADJUSTABLE STRAP SYSTEM FOR A GOLF BAG

RELATED APPLICATIONS

This is a continuation of U.S. patent application Ser. No. 15/724,168 filed on Jan. 22, 2018, which claims the benefit of U.S. Provisional Patent Application No. 62/403,570, filed on Oct. 3, 2016, the contents of which are entirely incorporated herewith.

FIELD

The present disclosure generally relates to an adjustable carrying strap system for bags.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are generally larger and heavier golf bags designed to be carried by a pull cart or transported by a golf cart, while the second class of golf club bags are generally smaller and lighter golf bags designed to be carried by the individual during play.

In particular, the second class of golf bags are usually referred to as "carry bags" which are carried by the individual using a carrying strap arrangement that may be used to lift and carry the golf bag. Many carrying bags have a carrying strap arrangement consisting of either one or two carrying straps for lifting and carrying the golf bag on the individual's shoulders. Specifically, a carrying strap arrangement having a pair of carrying straps may be arranged such that the first carrying strap crosses over the second carrying strap along a buckle that engages both carrying straps in a crossing fashion. This crossing arrangement using the buckle allows each carrying strap to be engaged to a respective shoulder of the individual when carrying the golf bag. Typically, the buckle defines a plurality of slots arranged to require each carrying strap be threaded through the buckle to permit one carrying strap to cross over the other carrying straps, which restrains, prevents, or pinches the carrying straps from moving as the individual carries the golf bag. As such, periodic adjustment of one or more carrying straps may be required when the golf bag shifts as the individual carries the golf bag, thereby requiring the individual to place the golf bag down in order to manually adjust the carrying straps. However, manual adjustment of the carrying straps can be cumbersome and time consuming as the individual may need to place the golf bag down and take the time to make the necessary adjustments to the carrying straps.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

Corresponding reference characters indicate corresponding elements among the various views of the drawings. The headings used in the figures should not be interpreted to limit the scope of the claims.

DETAILED DESCRIPTION

Figure 1:
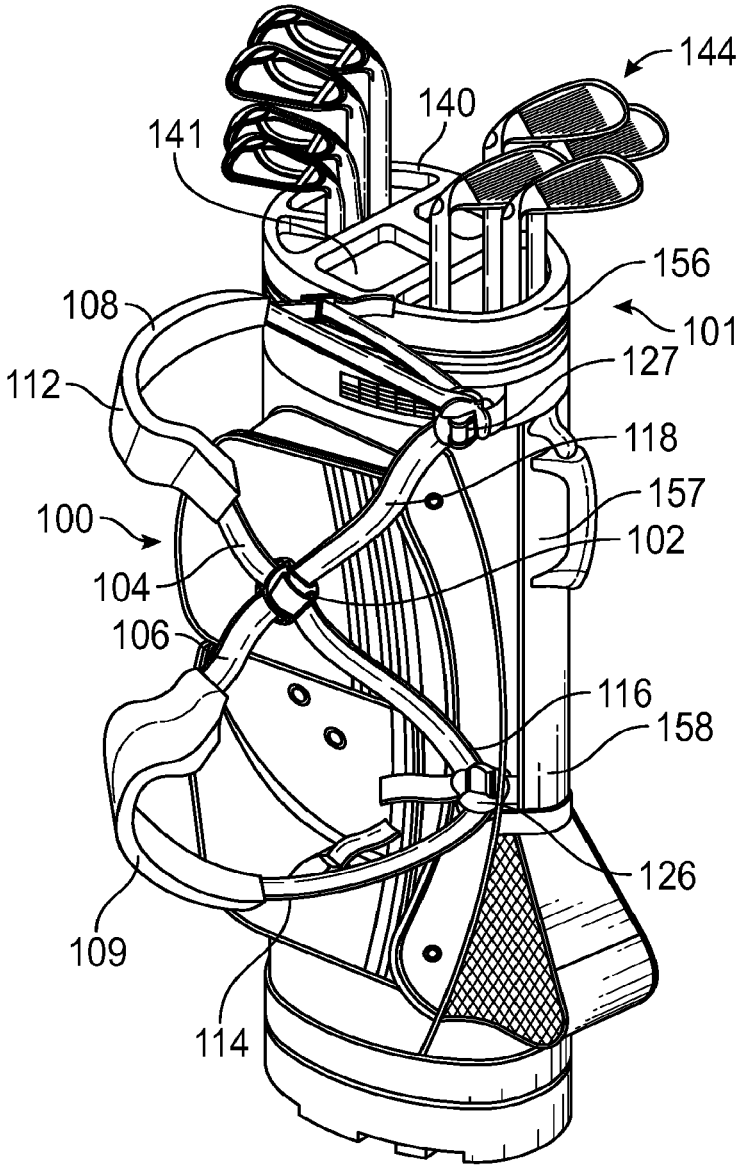
FIG. 1 is a perspective view of a golf bag coupled to an adjustable carrying strap system, according to aspects of the present disclosure.

As described herein, a bag having an adjustable carrying strap system and methods of manufacturing such a bag with the adjustable carrying strap system is configured and arranged to allow the carrying straps (generally described as a first carrying strap and a second carrying strap) of the bag to automatically adjust without requiring manual intervention by the individual. The adjustable carrying strap system includes a connector plate that has a plurality of slots that define a first pathway and a second pathway configured to receive the first carrying strap and second carrying strap, respectively, in an overlapping configuration. The slots are arranged to define a first pathway for receiving the first carrying strap and a second pathway for receiving the second carrying strap. The connector plate is configured to avoid pinching or clasping the first and/or second carrying straps and configured to facilitate easier tightening of the first and second carrying straps. In addition, the first and second carrying straps, along with the connector plate, allow the bag to be shifted in a side-to-side movement or up-and-down movement to make adjustments to the position of the bag relative to the individual carrying the bag. The arrangement of the first and second carrying straps engaged to the connector plate allows for a self-centering of the bag while mounted on the back of the individual. The bag as disclosed may be any bag attached to an adjustable carrying strap system, such as a golf bag for carrying golf clubs. Referring to the drawings, embodiments of the adjustable carrying strap system are illustrated and generally indicated as 100, 200 and 300 in FIGS. 1-30.

Referring to FIG. 1, a first embodiment of the adjustable carrying strap system, designated adjustable carrying strap system 100, is shown. The adjustable carrying strap system 100 is connected to a bag 101 that may contain weighted objects. In many embodiments, the bag 101 may be a golf bag having an opening 140 in communication with a chamber 141 configured to receive one or more golf clubs 144 therein. As shown, the bag 101 may include an upper portion 156 formed adjacent the opening 140, a middle portion 157 formed between the upper portion 156 and a lower portion 158, which forms the bottom part of the bag 101.

Figure 2:
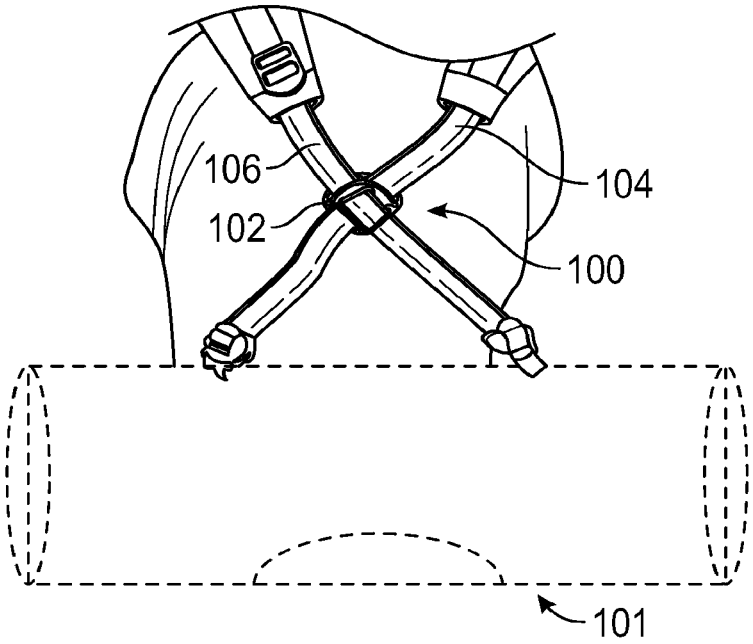
FIG. 2 is a perspective view of a bag with the adjustable carrying strap system engaged to an individual, according to aspects of the present disclosure.
Figure 3:
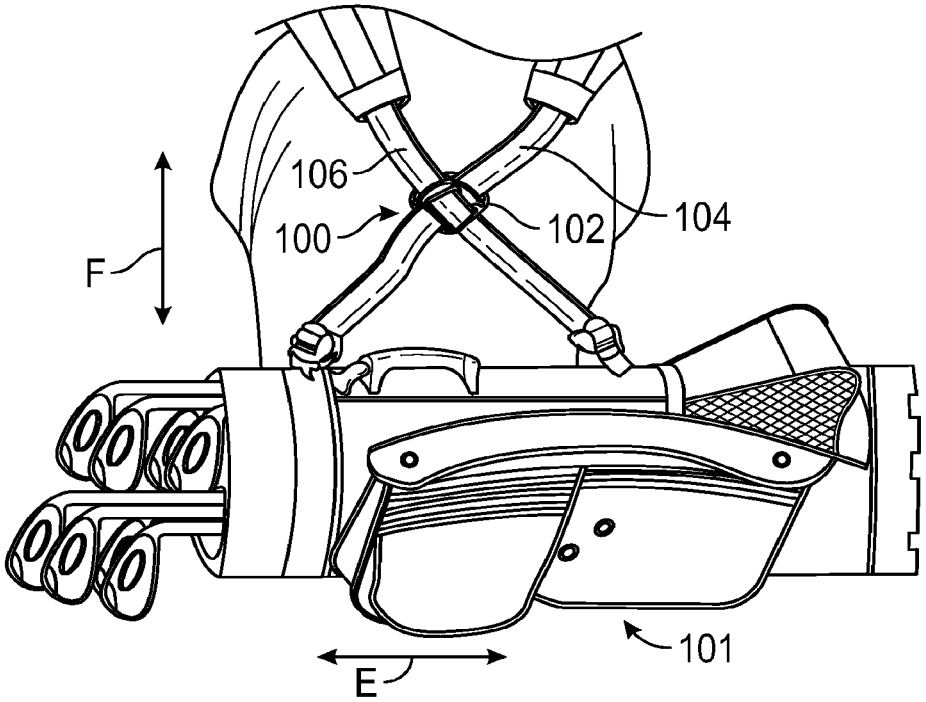
FIG. 3 is a perspective view of the golf bag with the adjustable carrying strap system engaged to an individual, according to aspects of the present disclosure.
Figure 12:
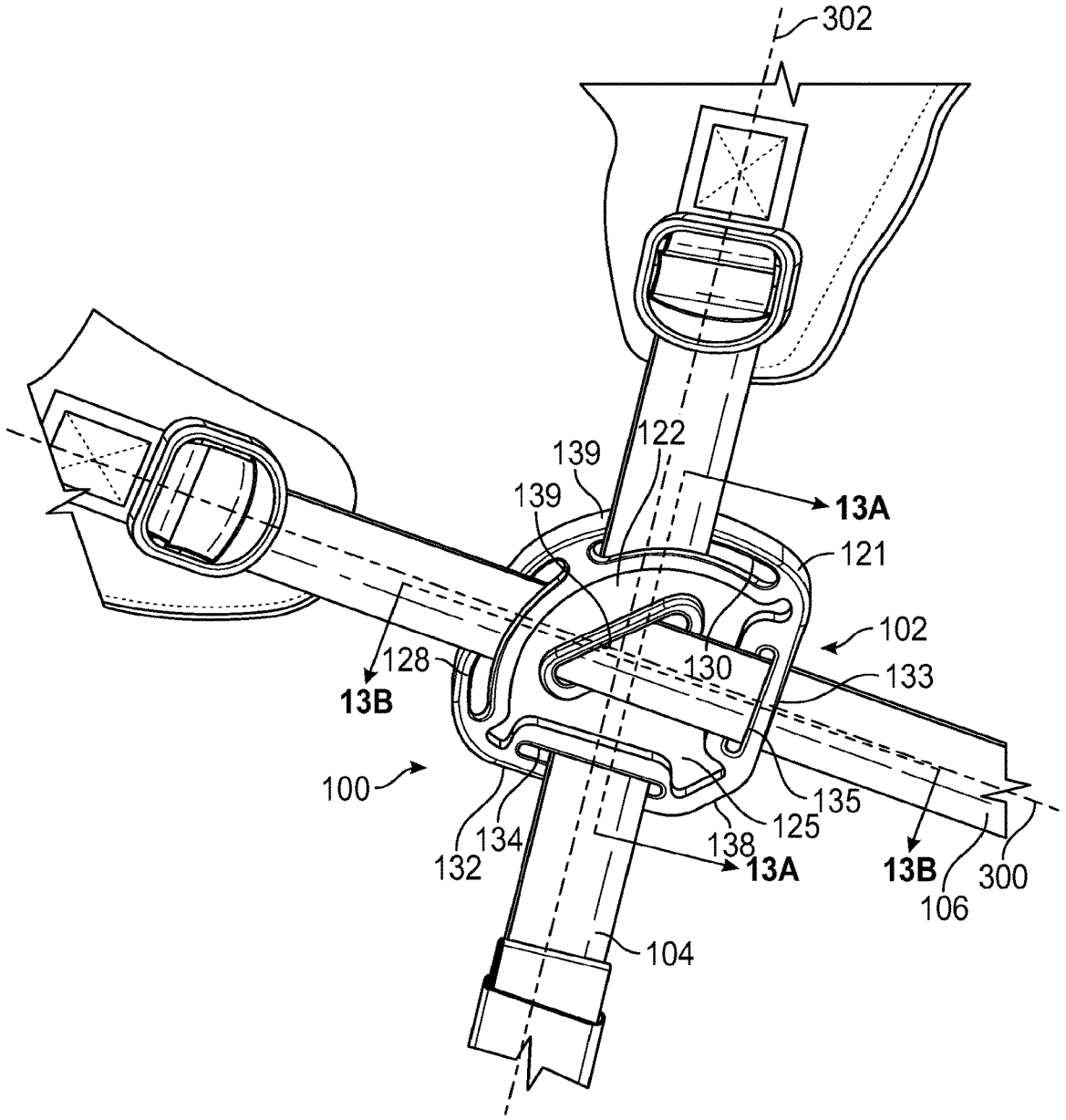
FIG. 12 is an enlarged front view of the adjustable carrying strap system showing the first carrying strap in overlapping relation with the second carrying strap engaged through the connector plate, according to aspects of the present disclosure.

As shown in FIGS. 1-3, the adjustable carrying strap system 100 includes a first carrying strap 104 and a second carrying strap 106 that overlap each other in a crossing fashion when engaged to a connector plate 102. The connector plate 102 is configured to allow the first and second carrying straps 104 and 106 to be adjustable relative to each other without any manual adjustment required by the individual such that the first and second carrying straps 104 and 106 move relative to each other along either axis 302 for the first carrying strap 104 or axis 300 for the second carrying strap 106 in response to the shifting of the bag 101 as shown in FIG. 12.

Referring back to FIG. 1, the first carrying strap 104 has an elongated configuration that defines a proximal portion 112 and an opposite distal portion 116. Similarly, the second carrying strap 106 also has an elongated configuration that defines a proximal portion 114 and an opposite distal portion 118. In some embodiments, the proximal portion 112 of the first carrying strap 104 may include a first shoulder pad 108 and the proximal portion 114 of the second carrying strap 106 may include a second shoulder pad 110 to provide a cushioning effect as the individual carries the bag 101. In some embodiments, the proximal portion 114 of the second carrying strap 106 may be engaged with the distal portion 116 of the first carrying strap 104 at a first connector arrangement 126 to couple together the first and second carrying straps 104 and 106 adjacent or proximate to the lower portion 158 of the bag 101. Similarly. the proximal portion 112 of the first carrying strap 104 may be engaged with the distal portion 118 of the second carrying strap 106 at a second connector arrangement 127 to couple together the first and second carrying straps 104 and 106 adjacent or proximate to the upper portion 156 of the bag 101. However, in other embodiments the first and second carrying straps 104 and 106 may be separately connected to the bag 101 using additional connector arrangements. In some embodiments, the first and second connector arrangements 126 and 127 may be a ring and loop arrangement, an independent buckle, a hook fastener arrangement, and a snap-fit connector arrangement.

Referring to FIGS. 4-11, the connector plate 102 is a modular component that may be added after-market to an existing bag 101. The connector plate 102 is configured to permit the first and second carrying straps 104 and 106 to overlap each other along the connector plate 102 and adjust relative to each other without manual intervention when the bag 101 shifts as it is being carried or as the bag 101 changes position relative to an individual carrying the bag 101 as illustrated in FIGS. 2 and 3. The connector plate 102 includes a connector plate body 120 defined by a front surface 122 and an opposite rear surface 123 collectively defining an arc region 124 and an apex region 125 that together form a general pre-shaped configuration. In some embodiments, the connector plate 102 may have a symmetrical configuration, an asymmetrical or tapered configuration, or a combination symmetrical and asymmetrical or tapered configuration, although the apparatus, articles of manufacture, and methods described herein are not limited in this regard. For example, the connector plate 102 may have a square configuration, a circular configuration, an oval configuration, and a rectangular configuration or a combination thereof.

Figure 4:
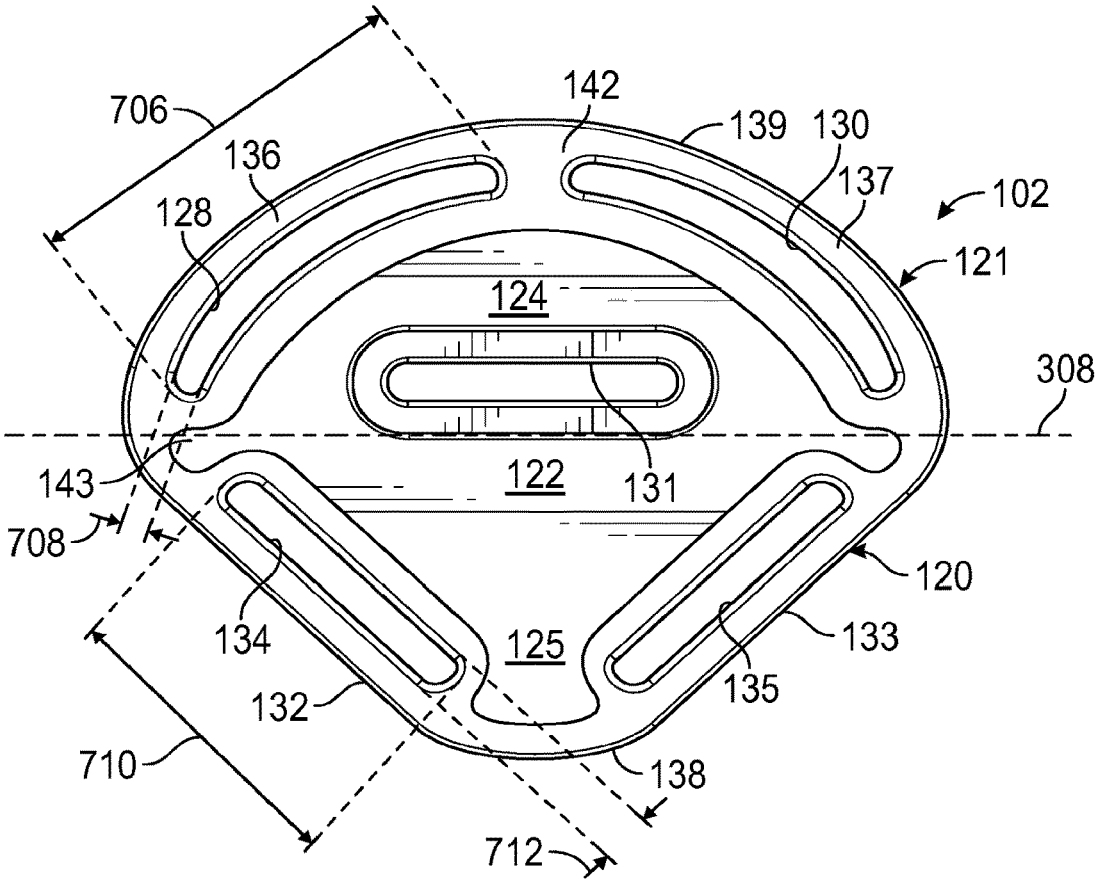
FIG. 4 is a front plan view of a first embodiment of the connector plate, according to aspects of the present disclosure.

As shown in FIG. 4, the circumference of the connector plate body 120 is defined by a peripheral edge 121 collectively formed by a first side 132, a second side 133, and a curved side 139. In some embodiments, the arc region 124 forms the upper half or portion of the connector plate body 120 defined above the latitudinal axis 308, while the apex region 125 forms the lower half or portion of the connector plate body 120 defined below the latitudinal axis 308. The apex region 125 further defines an apex 138 formed by the first and second sides 132 and 133 of the connector plate body 120.

Figure 5:
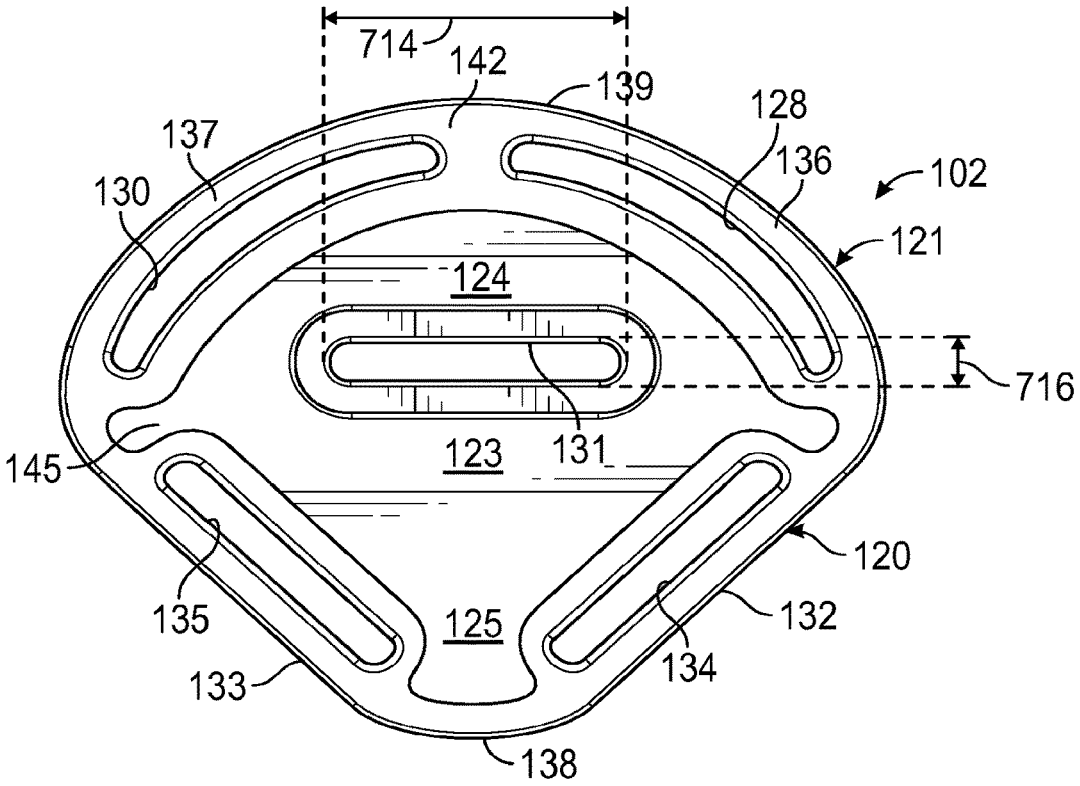
FIG. 5 is a rear plan view of the connector plate of FIG. 4, according to aspects of the present disclosure.

In some embodiments, the arc region 124 defines a first arc arm 136 formed adjacent a first arc slot 128 and a second arc arm 137 formed adjacent a second arc slot 130. A bridge 142 is formed between the first and second arc arms 136 and 137. In addition, a center slot 131 is defined between the first and second arc slots 128 and 130 and first and second straight slots 134 and 135. In addition, the apex region 125 defines a first straight slot 134 formed in parallel relation relative to the first side 132 of the apex region 125 and a second straight slot 135 formed parallel relation relative to the second side 133 of the apex region 125 and in perpendicular relation relative to the first straight slot 134. In some embodiments, a front recess portion 143 is formed along the front surface 122 of the connector plate body 120 and a rear recess portion 145 is formed along the rear surface 123 of the connector plate body 120 as shown in FIGS. 4 and 5.

Figure 13A:
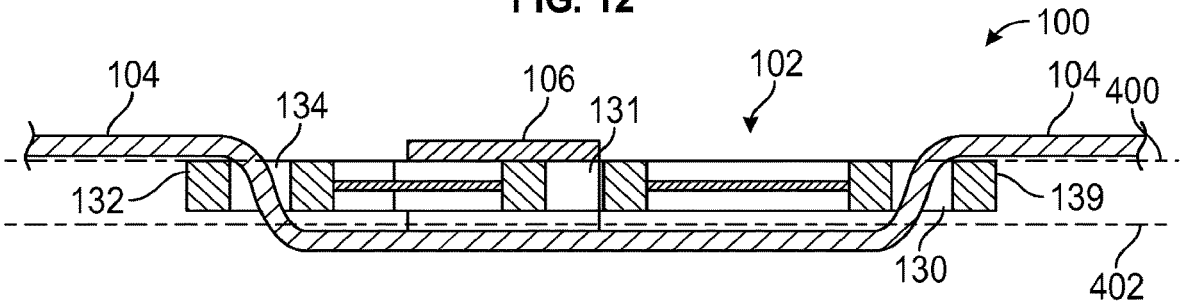
FIG. 13A is a cross sectional view of the adjustable carrying strap system taken along 13A-13A of FIG. 12, according to aspects of the present disclosure.
Figure 14:
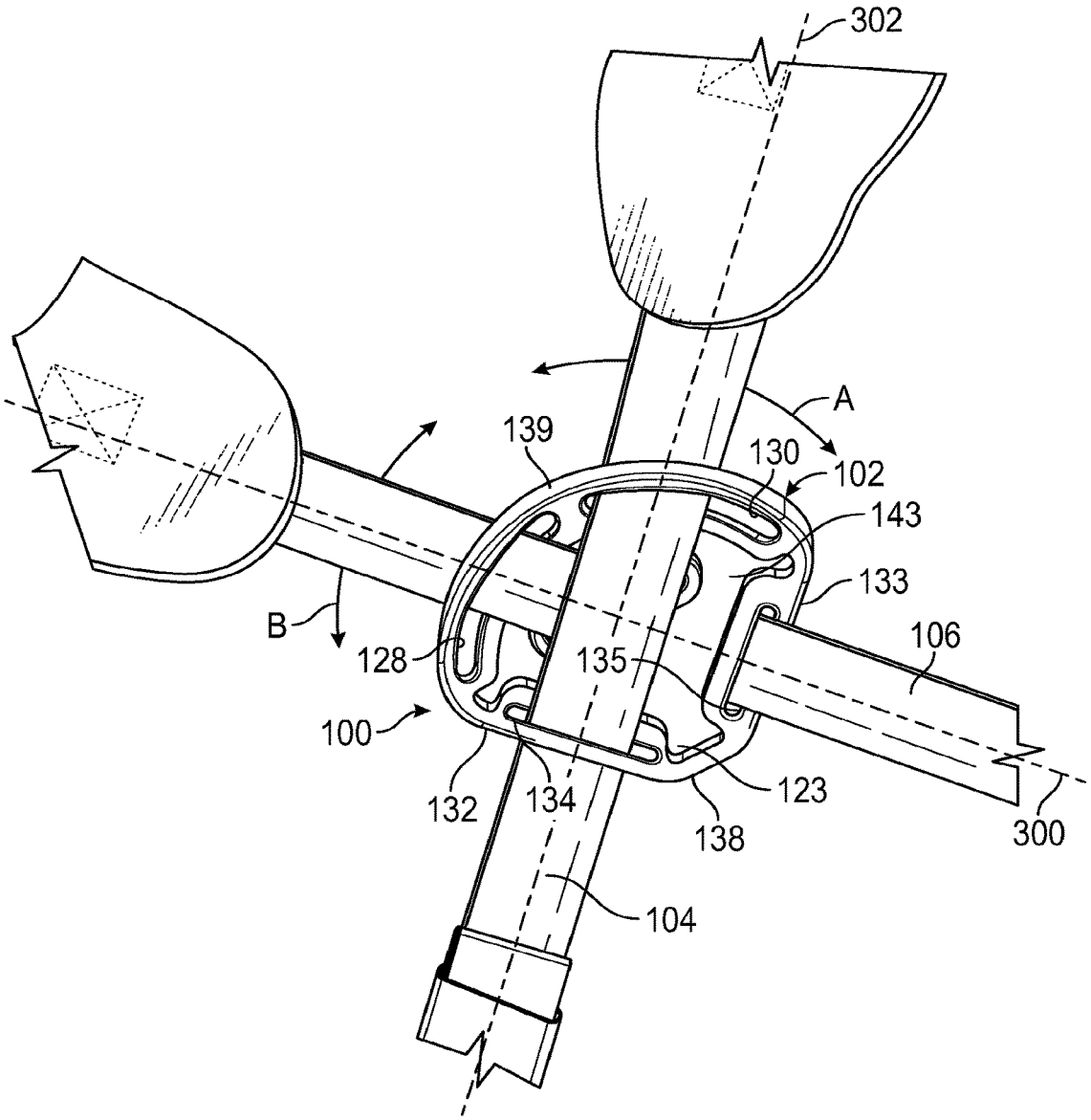
FIG. 14 is an enlarged rear view of the adjustable carrying strap system showing the first carrying strap in overlapping relation with the second carrying strap engaged through the connector plate, according to aspects of the present disclosure.

As shown in FIGS. 12, 13A and 14, in one arrangement of coupling the first carrying strap 104 to the connector plate 102 the first carrying strap 104 is received through the first straight slot 134, extends across the rear recess 145, and is received through the second arc slot 130 when engaging the first carrying strap 104 to the connector plate body 120 along the first pathway. Referring specifically to FIG. 13A, in this arrangement the first carrying strap 104 extends along an upper plane 400 that is adjacent to and in parallel relation to the front surface 122 of the connector plate body 120 to a lower plane 402 that is adjacent to and in parallel relation to the rear surface 123 of the connector plate body 120 before exiting the connector plate body 120 back along the upper plane 400.

Figure 13B:
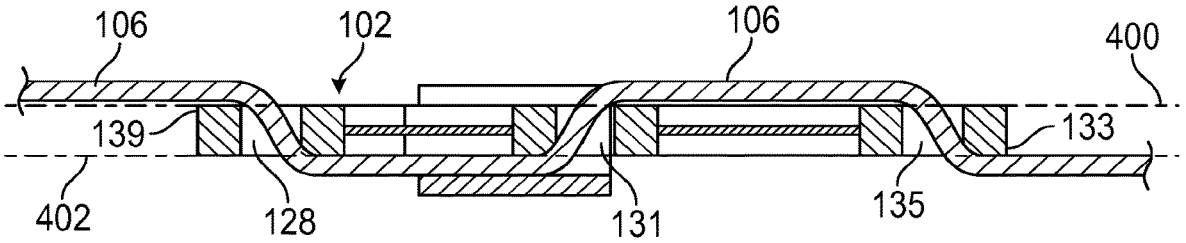
FIG. 13B is a cross sectional view of the adjustable carrying strap system taken along 13B-13B of FIG. 12, according to aspects of the present disclosure.

As shown in FIGS. 12, 13B, and 14, the second carrying strap 106 is received through the first arc slot 128, extends through the center slot 131, and is received through the second straight slot 135 when engaging the second carrying strap 106 to the connector plate body 120 along the second pathway. Referring specifically to FIG. 13B, in this arrangement the second carrying strap 106 extends along the upper plane 400 to the lower plane 402 and back to the upper plane 400 before exiting the connector plate body 120 along the lower plane 402.

Figure 15:
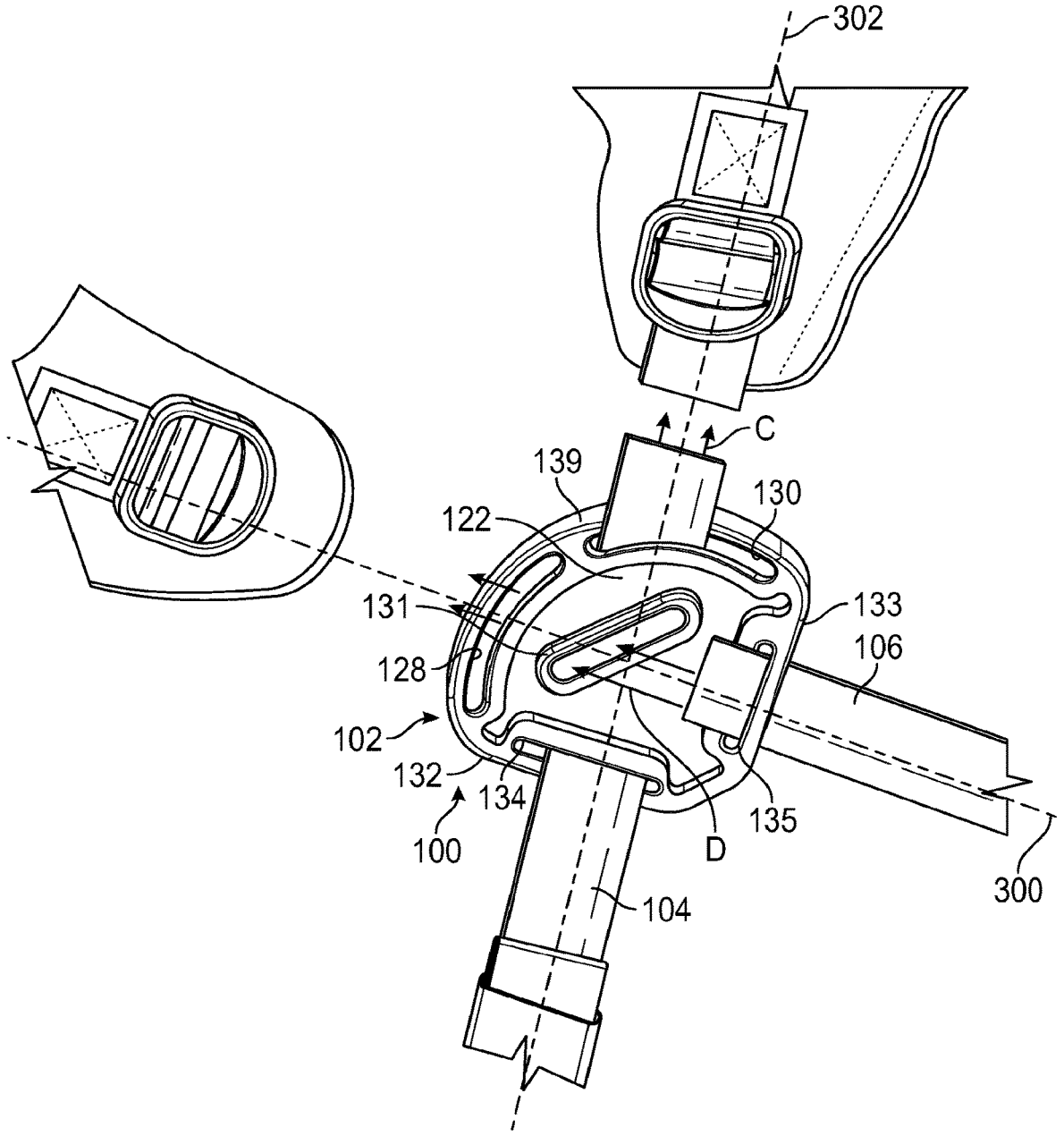
FIG. 15 is a front view of the adjustable carrying strap system showing the second carrying strap being engaged through the connector plate and in overlapping relation with the first carrying strap, according to aspects of the present disclosure.

Referring back to FIGS. 13A, 13B and 14, the upper plane 400 is defined adjacent or proximate to the front surface 122 of the connector plate body 120 and extends in parallel fashion to the first pathway along longitudinal axis 302 and the second pathway along latitudinal axis 300. When the first carrying strap 104 crosses over the second carrying strap 106 along the connector plate 102, both the first and second carrying straps 104 and 106 are disposed adjacent or proximate to the lower plane 402. As shown in FIG. 15, when assembling the adjustable carrying strap system 100, the first carrying strap 104 may be received along the first pathway in direction C, while the second carrying strap 106 may be received along the second pathway in direction D; however, in other embodiments, the insertion of the first and second carrying straps 104 and 106 along the first and second pathways may be in a direction opposite to directions C and D, respectively.

In some embodiments, the connector plate 102 includes two slots or openings defined along the upper part of the connector plate body 120 and a slot or opening defined in the middle part of the connector plate body 120 and two slots defined along the lower part of the connector plate body 120. This 2-1-2 arrangement of slots or openings along the connector plate body 120 defines a first pathway in transverse orientation with a second pathway along two different planes that extend above and below the front and rear surfaces of the connector plate body 120, respectively, and allow the first and second carrying straps to overlap.

Figure 6:
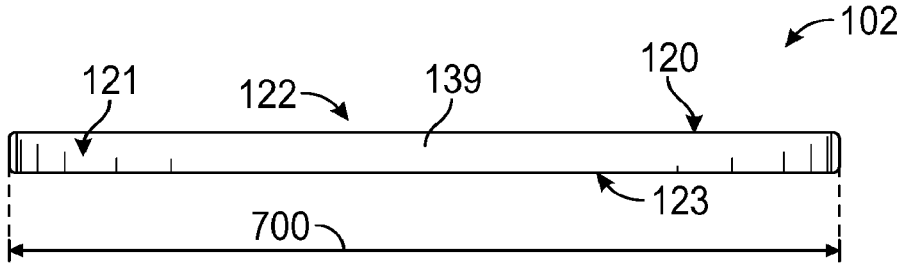
FIG. 6 is a side view of the connector plate of FIG. 4, according to aspects of the present disclosure.
Figure 7:
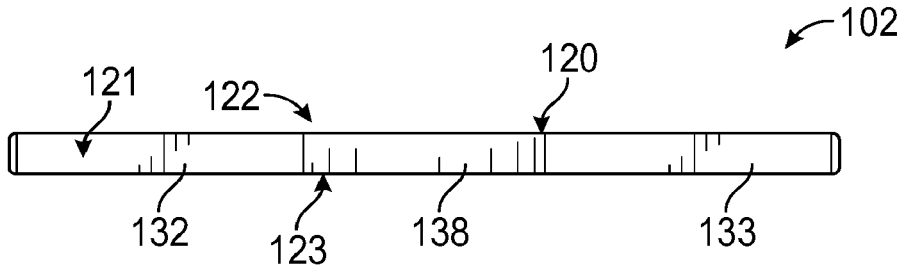
FIG. 7 is an opposite side view of the connector plate of FIG. 4, according to aspects of the present disclosure.
Figure 8:
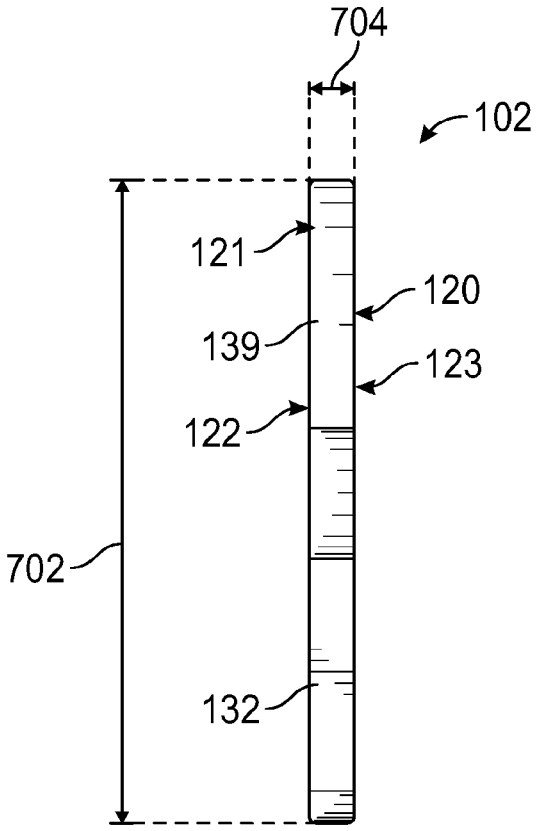
FIG. 8 is an end view of the connector plate of FIG. 4, according to aspects of the present disclosure.
Figure 9:
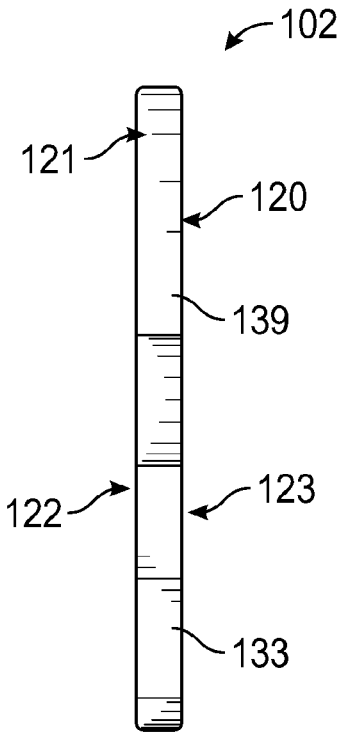
FIG. 9 is an opposite view of the connector plate of FIG. 4, according to aspects of the present disclosure.
Figure 10:
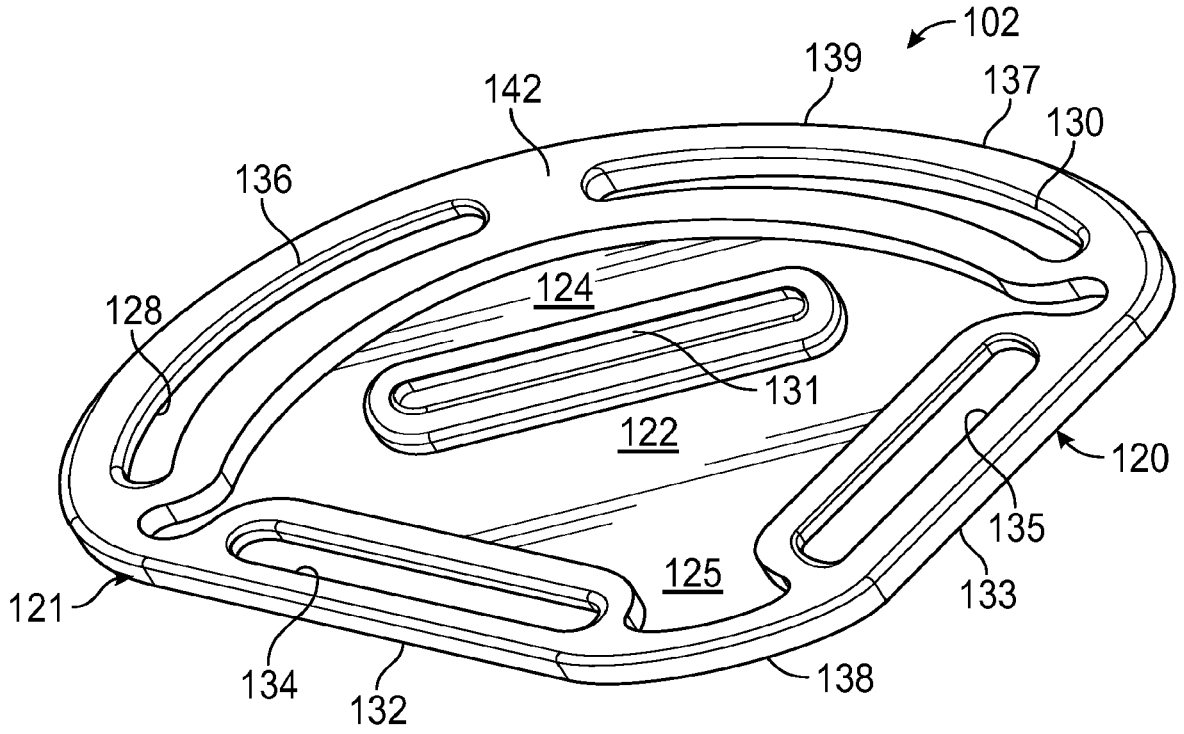
FIG. 10 is a perspective front view of the connector plate of FIG. 4, according to aspects of the present disclosure.
Figure 11:
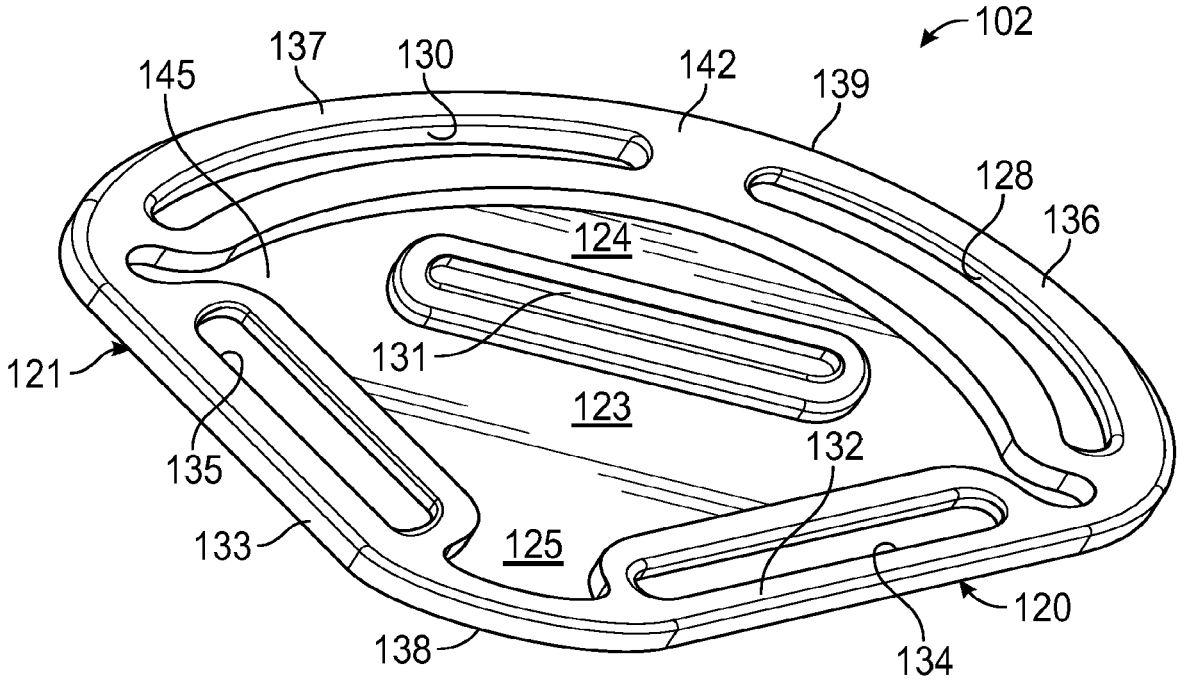
FIG. 11 is a perspective rear view of the connector plate of FIG. 4, according to aspects of the present disclosure.

As shown in FIG. 6, in some embodiments the connector plate 102 may have a length 700 that is in a range between 75 mm to 89.5 mm corresponding to the overall length of the connector plate body 120. Referring to FIG. 8, in some embodiments the connector plate 102 may have a height 702 defined between the bridge 142 and the apex 138 that is in a range between 64 mm to 76 mm and a width 704 of 5 mm. Referring to FIG. 4, in some embodiments the first and second arc slots 128 and 130 may have a length 706 that is in a range between 30.5 mm to 42.5 mm and the first and second straight slots 134 and 135 may have a length 710 of that is in the range between 26 mm to 30.5 mm. In addition, the first and second arc slots 128 and 130 may have a width 708 of 5 mm and the first and second straight slots 134 and 135 may have a width 712 of 5 mm. Finally, the center slot 131 may have a length 714 of 30.5 mm and a width 716 of 5 mm.

In some embodiments, the lengths 706 of the first and second arc slots 128 and 130 are longer than the width of the first and second carrying straps 104 and 106 which allows the first carrying strap 104 to shift in a side-by-side movement A and the second carrying strap 106 to shift in a similar side-by-side movement B as illustrated in FIG. 14. The side-by-side movements A and/or B allow for angle adjustments to the first carrying strap 104 and/or second carrying strap 106 as the individual carrying the bag 101 uses a side-by-side movement and/or up-and-down movement of the bag 101 to make such adjustments.

Figure 30:
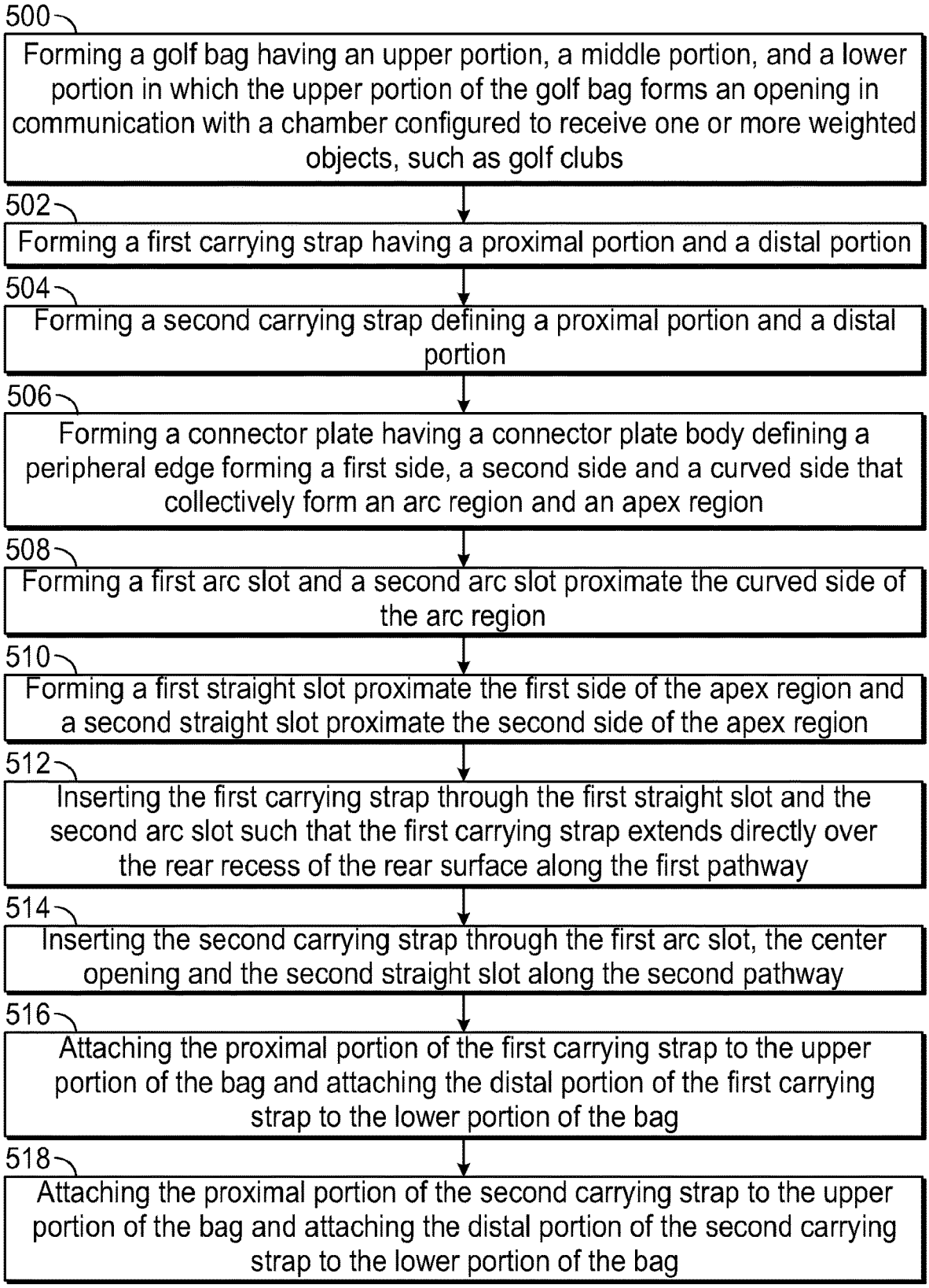
FIG. 30 is a flow chart illustrating a method for manufacturing the golf bag with the adjustable carrying strap system described herein, according to aspects of the present disclosure.

One method of manufacturing the bag 101 with the adjustable carrying strap system 100 for a golf bag 101 is illustrated in FIGS. 15 and 30. Referring specifically to the flow chart in FIG. 30, at block 500 the method comprises forming a golf bag 101 having an upper portion 156, a middle portion 157, and a lower portion 158 in which the upper portion 156 of the golf bag 101 forms an opening 140 in communication with a chamber 141 configured to receive one or more weighted objects, such as golf clubs 144. At block 502, the method comprises forming a first carrying strap 104 having a proximal portion 112 and a distal portion 116. At block 504, the method comprises forming a second carrying strap 106 defining a proximal portion 114 and a distal portion 118. At block 506, the method comprises forming a connector plate 102 having a connector plate body 120 defining a peripheral edge 121 forming a first side 132, a second side 133 and a curved side 139 that form an arc region 124 and an apex region 125, respectively. At block 508, the method comprises forming a first arc slot 128 and a second arc slot 130 proximate the curved side 139 of the arc region 124. At block 510, the method comprises forming a first straight slot 134 proximate the first side 132 of the apex region 125 and a second straight slot 135 proximate the second side 133 of the apex region 125. At block 512, the method comprises inserting the first carrying strap 104 through the first straight slot 134 and the second arc slot 130 such that the first carrying strap 104 extends directly over the rear recess 145 of the rear surface 123 along the first pathway. At block 514, the method comprises inserting the second carrying strap 106 through the first arc slot 128, the center slot 131 and the second straight slot 135 along the second pathway. In this arrangement of the first and second carrying straps 104 and 106, the second carrying strap 106 overlaps the first carrying strap 104 in a transverse orientation. At block 516, the method comprises attaching the proximal portion 112 of the first carrying strap 104 to the upper portion 156 of the bag 101 and attaching the distal portion 116 of the first carrying strap 104 to the lower portion 158 of the bag 101. At block 518, the method comprises attaching the proximal portion 114 of the second carrying strap 106 to the upper portion 156 of the bag 101 and attaching the distal portion 118 of the second carrying strap 106 to the lower portion 158 of the bag 101. In addition, the first and second carrying straps 104 and 106 may move relative to each other such that each respective first and second carrying strap 104 and 106 automatically adjusts without manual intervention by the individual whenever the bag 101 shifts as the individual is carrying the bag 101.

In some embodiments, the connector plate body 120 may be formed using a molding process, a stamping process, a milling process, and a combination thereof. In some embodiments, the connector plate body 120 may be made from a plastic, metal, or a composite material.

Referring to FIGS. 16-19, a second embodiment of an adjustable carrying strap system, designated 200, is illustrated. Similar to the connector plate 102, the connector plate 202 is a modular component that may be added after-market to an existing bag 101 (FIG. 1). The connector plate 202 is also configured to permit the first and second carrying straps 204 and 206 to overlap each other along the connector plate 202 and move relative to each other without manual intervention when the bag 101 shifts as it is being carried or as the bag 101 changes position relative to an individual carrying the bag 101. As shown, the connector plate 202 includes a connector plate body 220 defined by a front surface 222 and an opposite rear surface 123 collectively defining an arc region 224 and an apex region 225. In some embodiments, the connector plate 202 may have a symmetrical configuration, an asymmetrical or tapered configuration, or a combination symmetrical and asymmetrical or tapered configuration, although the apparatus, articles of manufacture, and methods described herein are not limited in this regard. For example, the connector plate 202 may have a square configuration, a circular configuration, an oval configuration, and a rectangular configuration.

Figure 16:
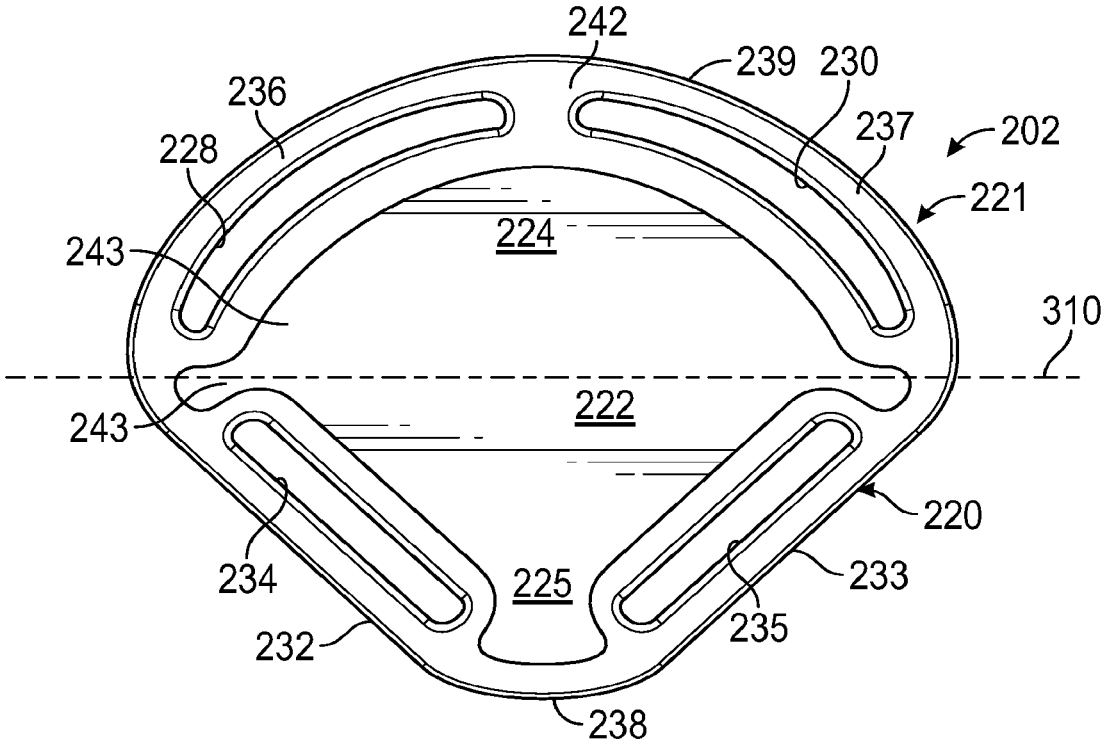
FIG. 16 is a front view of a second embodiment of the connector plate.
Figure 17:
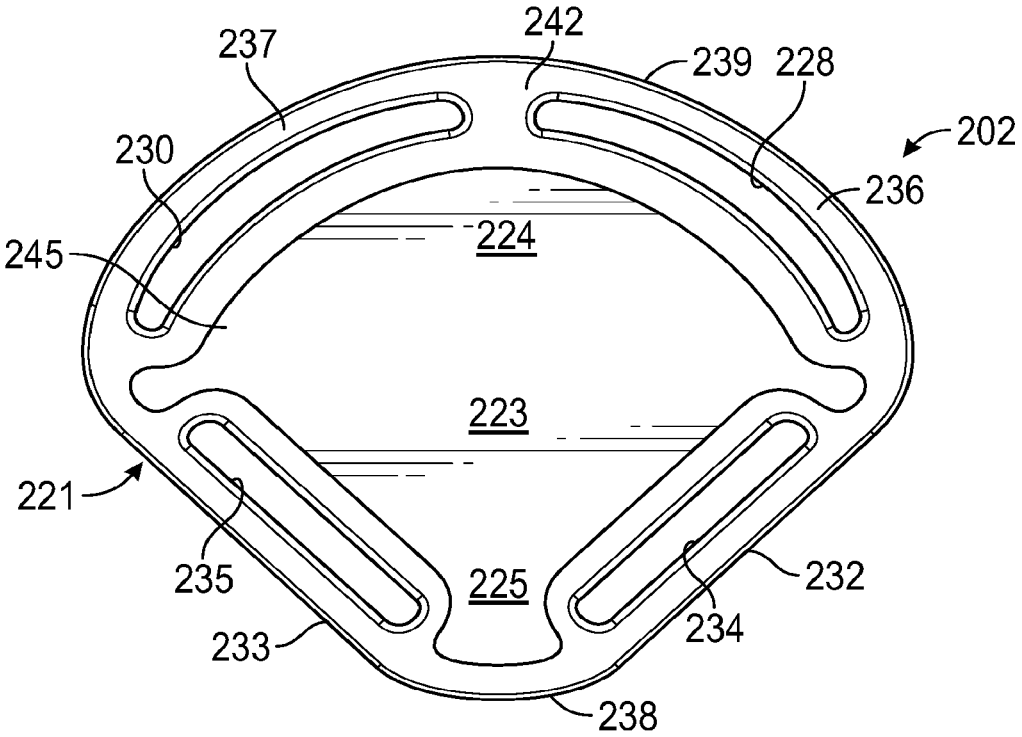
FIG. 17 is a rear view of the connector plate of FIG. 16, according to aspects of the present disclosure.
Figure 18:
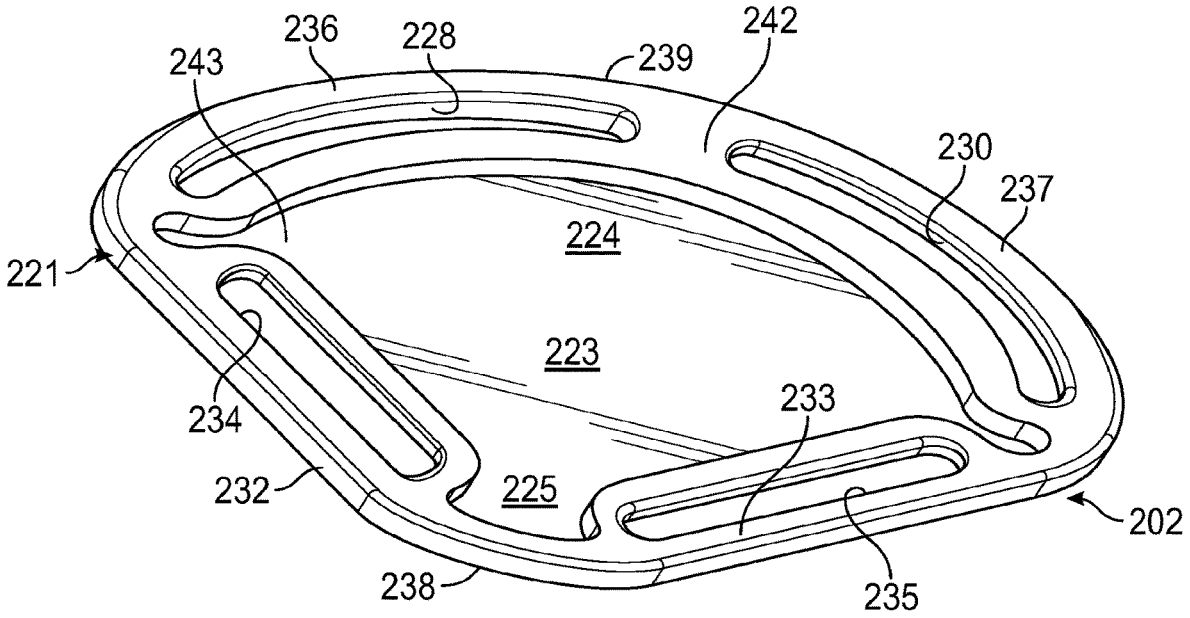
FIG. 18 is a perspective view of the connector plate of FIG. 16, according to aspects of the present disclosure.

As shown in FIG. 16, the circumference of the connector plate body 220 is defined by a peripheral edge 221 collectively formed by a first side 232, a second side 233, and a curved side 239. The arc region 224 forms the upper half or portion of the connector plate body 220 defined above the latitudinal axis 310. The apex region 225 forms the lower half and/or portion of the connector plate body 220 defined below the latitudinal axis 310. As shown, an apex 238 is formed between the first and second sides 232 and 233 of the connector plate body 220.

In some embodiments, the arc region 224 defines a first arc arm 236 formed adjacent to the first arc slot 228 and a second arc arm 237 formed adjacent the second arc slot 230 with a bridge 242 formed between the first and second arc arms 236 and 237. In this embodiment, the connector plate body 220 does not include a center slot 131. As further shown, the apex region 225 defines a first straight slot 234 formed along the first side 232 and a second straight slot 235 formed along the second side 233 and in perpendicular relation relative to the first straight slot 234. In some embodiments, a front recess portion 243 is formed along the front surface 222 of the connector plate body 220 and a rear recess 245 is formed along the rear surface 223 of the connector plate body 220.

Figure 19:
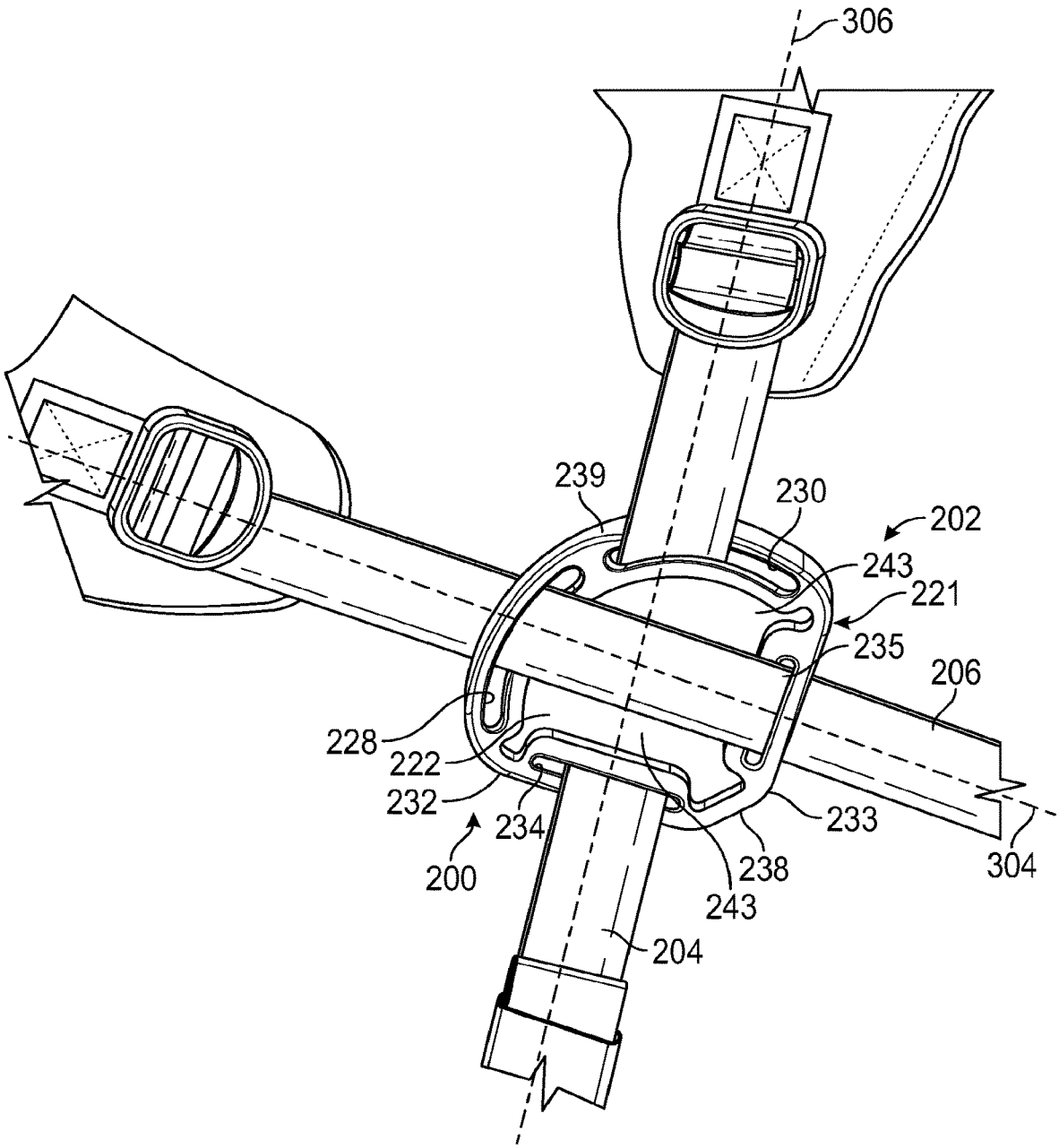
FIG. 19 is a front view of a second embodiment of the adjustable carrying strap system showing the second carrying strap in overlapping relation with the first carrying strap engaged through the connector plate of FIG. 16, according to aspects of the present disclosure.

Referring to FIG. 19, in some embodiments the first straight slot 234 and the second arc slot 230 collectively define a first pathway along the connector plate body 220 configured to receive the first carrying strap 204, while the first arc slot 228 and the second straight slot 235 collectively define a second pathway along the connector plate body 220 configured to receive the second carrying strap 206. In some embodiments, the first pathway extends along an axis 306 and the second pathway extends along an axis 304 that is oriented substantially perpendicular to axis 306 to form an overlapping configuration between the first and second carrying straps 204 and 206.

As further shown, in one arrangement of coupling the first carrying strap 204 to the connector plate 202 the first carrying strap 204 is received through the first straight slot 234, extends across the rear recess 245 of the rear surface 223, and is received through the second arc slot 230 when engaging the first carrying strap 204 to the connector plate body 220 along the first pathway. In one arrangement of coupling the second carrying strap 204 to the connector plate 202 the second carrying strap 206 is received through the first arc slot 228, extends across the front recess portion 243 of the front surface 222, and is received through the second straight slot 235 when engaging the second carrying strap 206 to the connector plate body 220 along the second pathway.

The operation and functionality of the adjustable carrying strap system 200 are substantially the same as the adjustable carrying strap system 100 discussed above. In particular, the adjustable carrying strap system 200 allows for angle adjustments to the first carrying strap 204 and/or second carrying straps 206 as the individual carrying the bag 101 uses a side-by-side movement and/or up-and-down movement of the bag 101 to make such adjustments.

Figure 20:
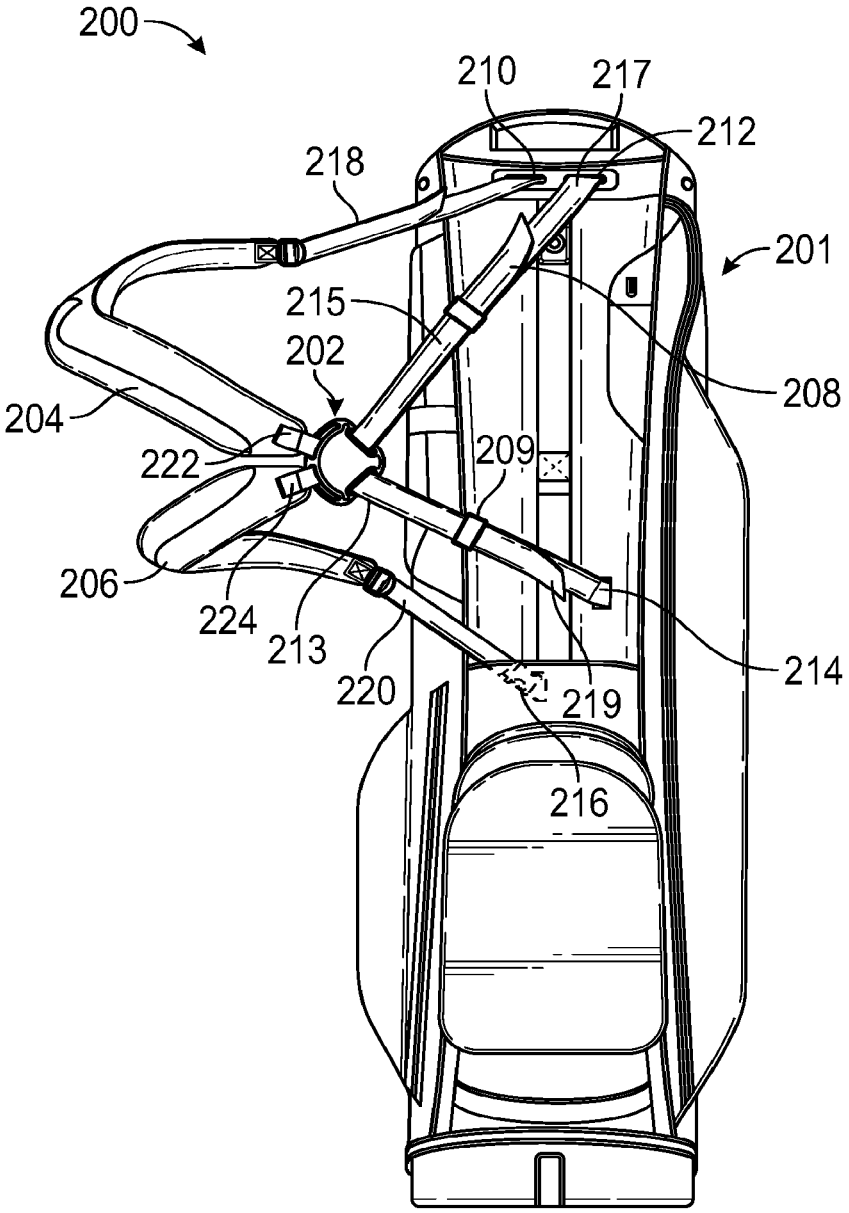
FIG. 20 is a front view of a golf bag with an adjustable carrying strap system coupled to the connector plate of FIG. 16, according to aspects of the present disclosure.
Figure 21:
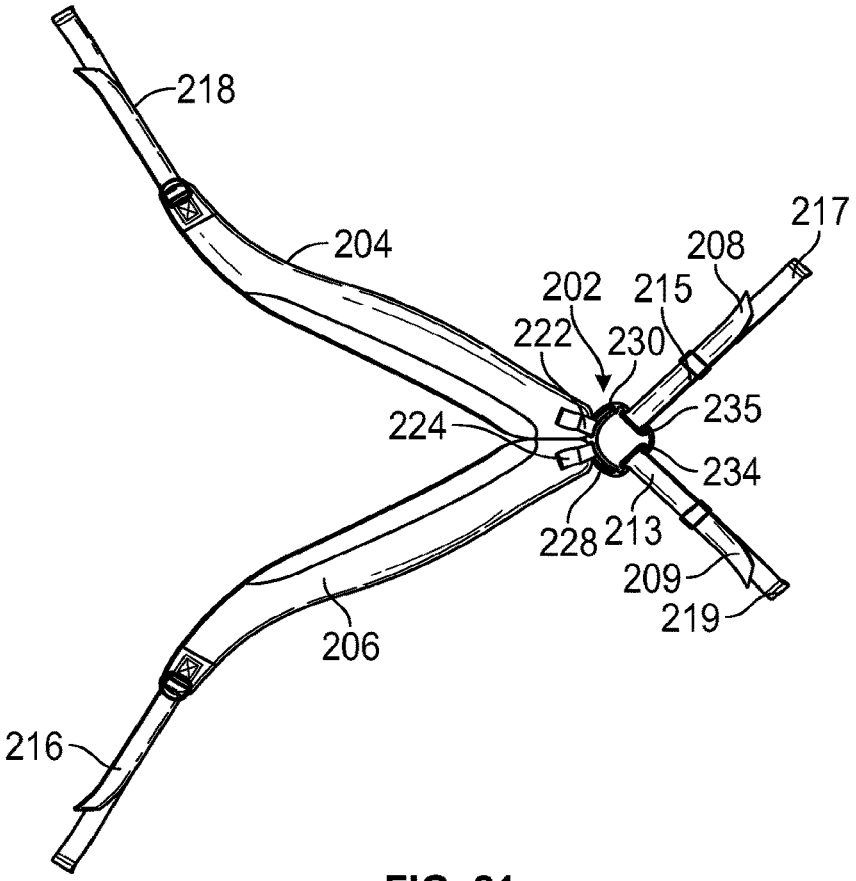
FIG. 21 is a front view of the adjustable carrying strap system of FIG. 20.
Figure 22:
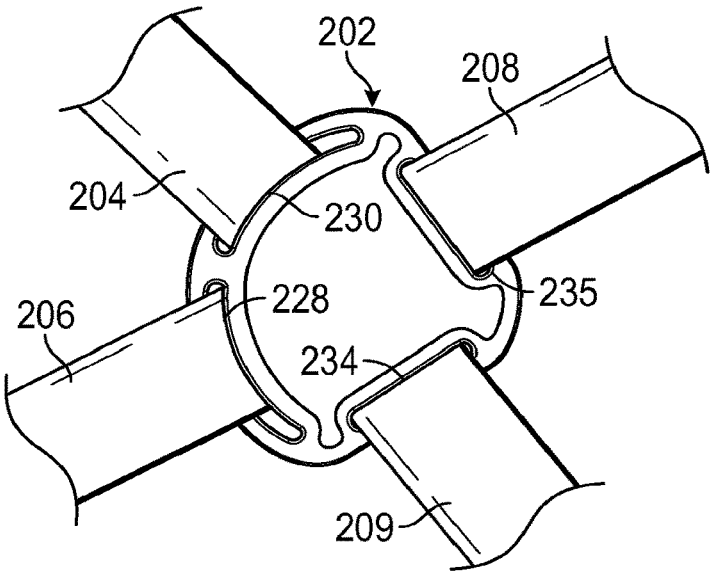
FIG. 22 is an enlarged view of FIG. 21 showing the connector plate of FIG. 16 coupled to the carrying strap system, according to aspects of the present disclosure.

Referring to FIGS. 20-22, another embodiment of the adjustable carrying strap system 200 for coupling with the connector plate 202 is illustrated. In some embodiments, the adjustable carrying strap system 200 is coupled to a golf bag 201 through a first carrying strap 204, a second carrying strap 206, a third carrying strap 208 and a fourth carrying strap 209. Specifically, the first carrying strap 204 defines a proximal portion 218 coupled to the golf bag 201 along a first slot 210 and a distal portion 222 coupled to the connector plate 202 in a loop configuration through the second arc slot 230. The second carrying strap 206 defines a proximal portion 220 coupled to a quick-release buckle clip arrangement 216 (shown in phantom) attached to the golf bag 201 and a distal portion 224 coupled to the connector plate 202 in a loop configuration through the first arc slot 228. Alternatively, the proximal portion 220 of the second carrying strap 206 may be sewn directly to the body of the golf bag 201 rather than coupled to the quick-release buckle clip arrangement 216. In addition, the third carrying strap 208 defines a proximal portion 217 coupled to the golf bag 201 along a second slot 212 and a distal portion 215 coupled to the connector plate 202 in a loop configuration through the second straight slot 235. The fourth carrying strap 209 defines a proximal portion 219 coupled to the golf bag 201 through a third slot 214 and a distal portion 213 coupled to the connector plate 202 in a loop configuration through the first straight slot 234. In some embodiments, the proximal portion 219 of the fourth carrying strap 209 may be inserted through the third slot 214 for operative engagement with a pair of deployable legs (not shown) attached to the golf bag 201 which are retracted by the fourth carrying strap 209 when lifted upward onto the shoulders of the individual carrying the golf bag 201.

In some embodiments, a free end of the distal portion 215 of the third carrying strap 208 can be sewn to the remainder of the distal portion 215. In other embodiments, the free end of the distal portion 215 of the third carrying strap 208 can be coupled to the remainder of the distal portion 215 using a clasp, an adhesive, or any other suitable mechanism. Further, in some embodiments, a free end of the distal portion 213 of the fourth carrying strap 209 can be sewn to the remainder of the distal portion 213. In other embodiments, the free end of the distal portion 213 of the fourth carrying strap 209 can be coupled to the remainder of the distal portion 213 using a clasp, an adhesive, or any other suitable mechanism.

In some embodiments, the free ends of the proximal portions 217 and 218 may be configured in an overlapping fashion to allow passage through the respective first and second slots 210 and 212 in a first orientation (e.g., parallel orientation relative to the respective slots 210 and 212), while preventing passage of the free ends of the proximal portions 217 and 218 back through the respective first and second slots 210 and 212 when the free ends are in a second orientation (e.g., perpendicular orientation relative to the respective slots 210 and 212). In this arrangement, the proximal portions 217 and 218 establish a secure engagement with the body of the golf bag 201.

In some embodiments, the distal portion 215 of the third carrying strap 208 and the distal portion 213 of the fourth carrying strap 209 may each include a ladder lock to provide an easier way of adjusting the respective lengths of the third and fourth straps 208 and 209. In some embodiments, the proximal portions 216 and 218 may include a strap tightness adjustment ladder lock to adjust the respective lengths of the first and second carrying straps 204 and 206.

The arrangement of the first carrying strap 204, the second carrying strap 206, third carrying strap 208, and fourth carrying strap 209 coupled to the connector plate 202 as described above provides a self-centering function for the golf bag 201 when mounted onto the shoulders of the individual.

Figure 23:
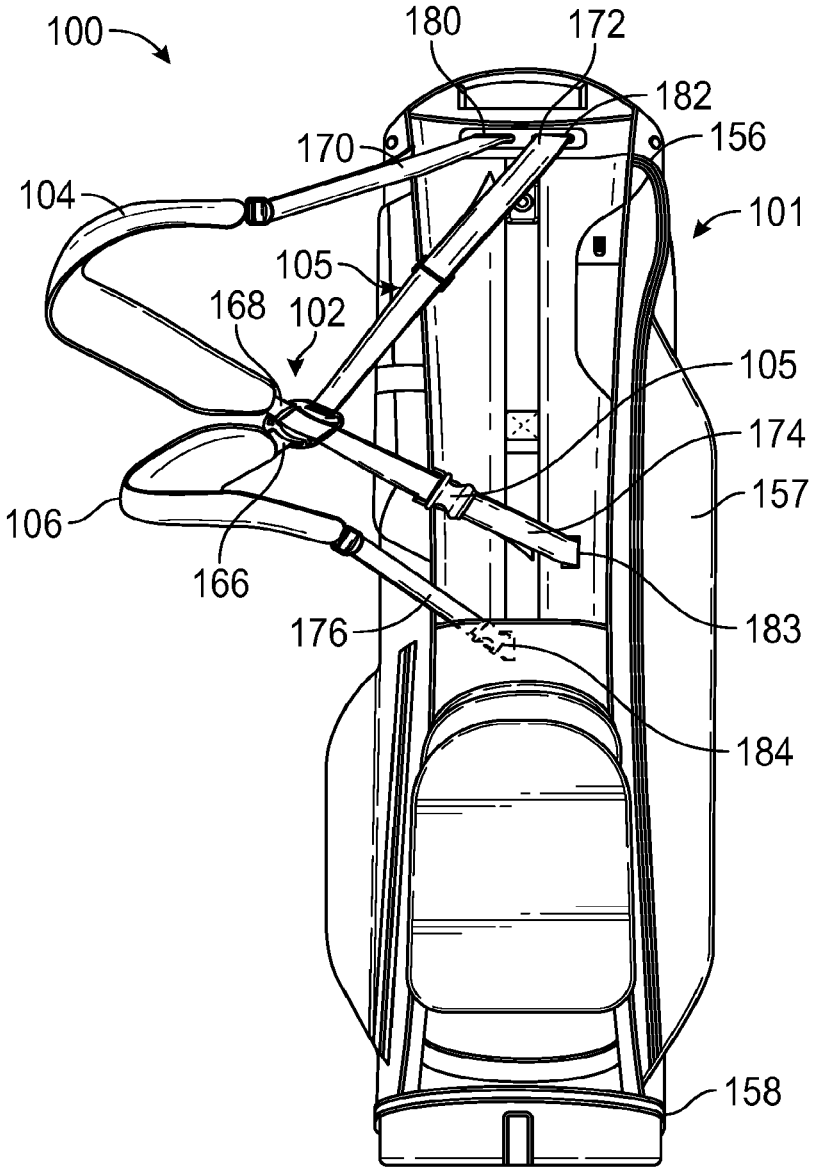
FIG. 23 is a front view of a golf bag with an adjustable carrying strap system coupled to the connector plate of FIG. 4, according to aspects of the present disclosure.
Figure 24:
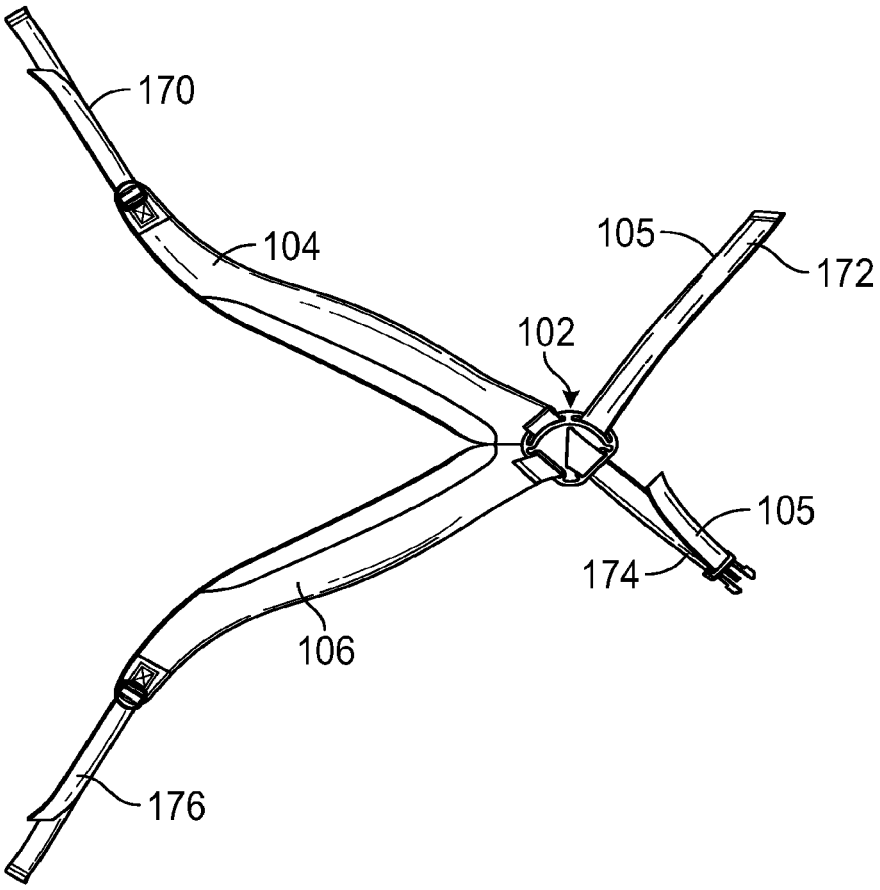
FIG. 24 is front view of the adjustable carrying strap system of claim 23, according to aspects of the present disclosure.
Figure 25:
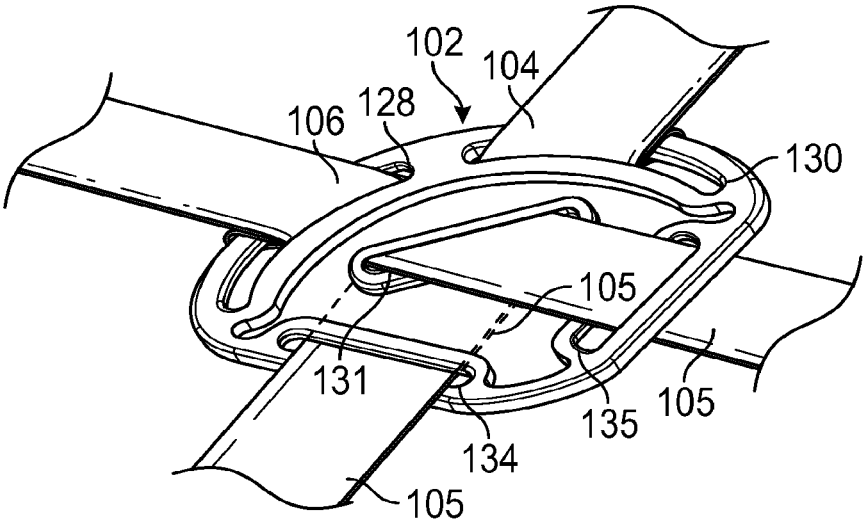
FIG. 25 is an enlarged view of FIG. 24 showing the connector plate of FIG. 4 coupled to the carrying strap system, according to aspects of the present disclosure;'

Referring to FIGS. 23-25, another embodiment of the adjustable carrying strap system 100 for coupling with the connector plate 102 is illustrated. In some embodiments, the adjustable carrying strap system 100 is coupled to the connector plate 102 through a first carrying strap 104, a second carrying strap 106, and a third carrying strap 105. Specifically, the first carrying strap 104 defines a proximal portion 170 coupled to the golf bag 101 along a first slot 180 and a distal portion 168 coupled to the connector plate 102 in a loop configuration through the second arc slot 130. The second carrying strap 106 defines a proximal portion 176 coupled to a quick-release buckle clip arrangement 184 attached to the golf bag 101 or sewn directly to the golf bag 101 and a distal portion 166 coupled to the connector plate 102 in a loop configuration through the first arc slot 128. The third carrying strap 105 defines a proximal portion 172 coupled to the golf bag 101 through a second slot 182 and a distal portion 174 coupled to the golf bag 101 through a third slot 183. In some embodiments, the proximal portion 174 of the third carrying strap 105 may be inserted through the third slot 183 for operative engagement with a pair of deployable legs (not shown) attached to the golf bag 101 which are retracted by the third carrying strap 105 when lifted upward onto the shoulders of the individual carrying the golf bag 101. In addition, a middle portion of the third carrying strap 105 defined between the proximal portion 172 and distal portion 174 is coupled to the connector plate 102. In some embodiments, the third carrying strap 105 may be inserted through the first straight slot 134, the center slot 131, and through the second straight slot 135 such that the third carrying strap 105 forms a perpendicular configuration between the portion of the third carrying strap 105 received through the first straight slot 134 and the portion of the third carrying strap 105 received through the second straight a lot 135 which allows the third carrying strap 105 to slide relative to the connector plate 102 when manually adjusted by the individual.

In some embodiments, the free ends of the proximal portions 170 and 172 may be configured in an overlapping fashion to allow passage through the respective first and second slots 180 and 182 in a first orientation (e.g., parallel orientation relative to the respective slots 180 and 182), while preventing passage of the free ends of the proximal portions 170 and 172 back through the respective first and second slots 180 and 182 when the free ends are in a second orientation (e.g., perpendicular orientation relative to the respective slots 180 and 182). In this arrangement, the proximal portions 170 and 172 establish a secure engagement with the body of the golf bag 101. The arrangement of the first carrying strap 104, the second carrying strap 106 and the third carrying strap 105 coupled to the connector plate 102 as described above provides a self-centering function for the golf bag 101 when mounted onto the shoulders of the individual. In the alternative, the free ends of the proximal portions 170 and 172 may be sewn or otherwise attached to the golf bag 101.

Figure 27:
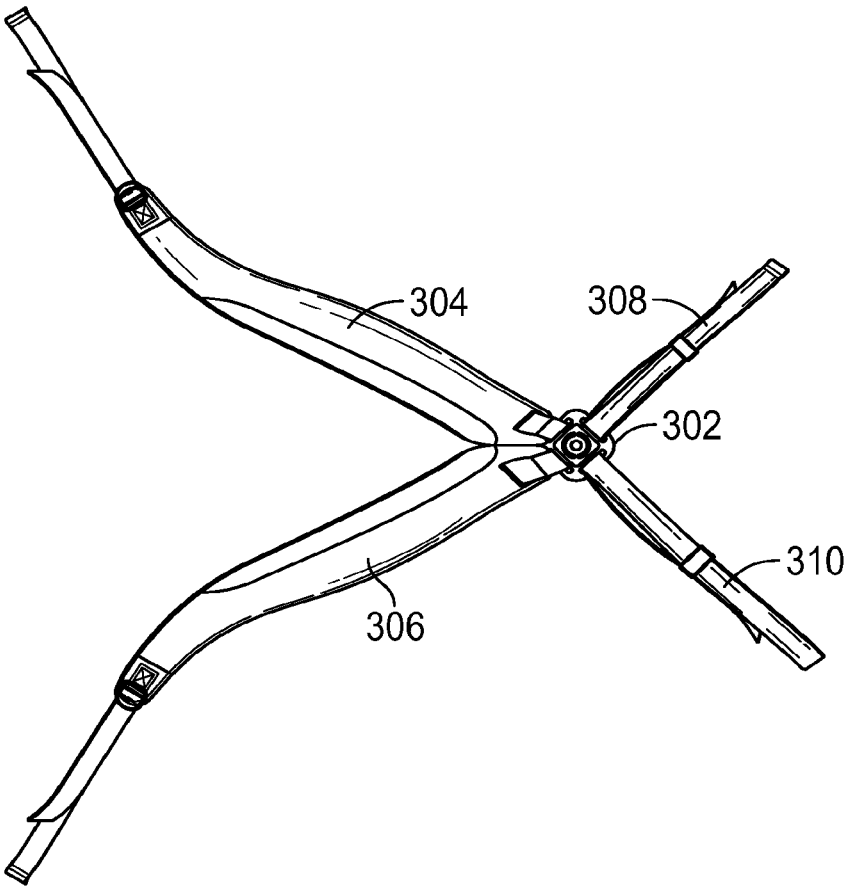
FIG. 27 is a front view of the adjustable carrying strap system of FIG. 26, according to aspects of the present disclosure.
Figure 28:
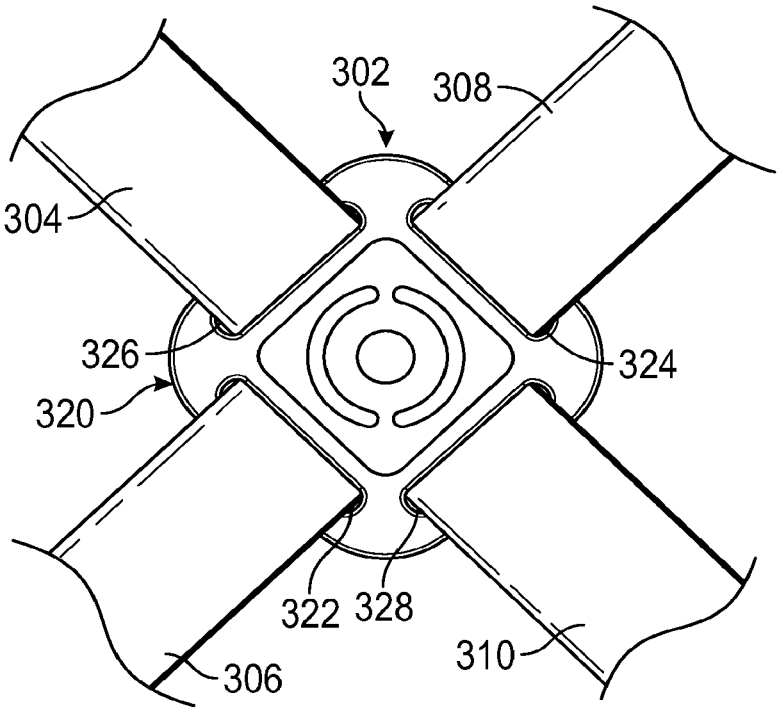
FIG. 28 is an enlarged view of FIG. 27 showing the connector plate of FIG. 29 coupled to the carrying strap system.
Figure 29:
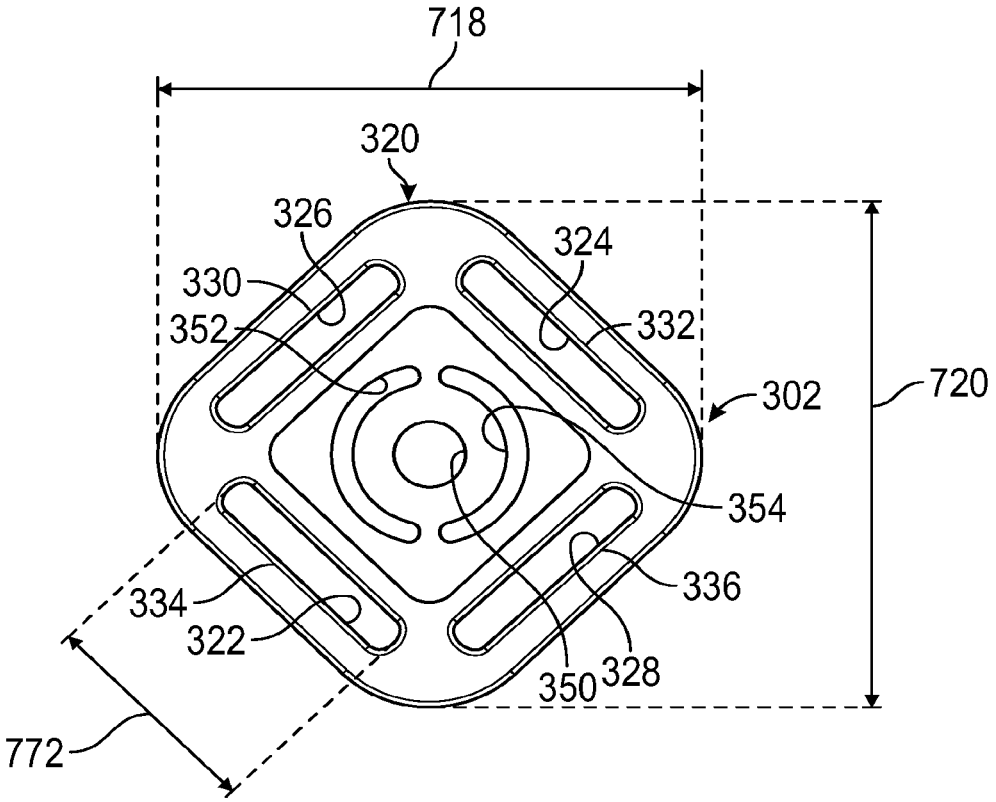
FIG. 29 is a front view of the third embodiment of the connector plate shown in FIG. 26, according to aspects of the present disclosure

Referring to FIGS. 26-29, another embodiment of the adjustable carrying strap system, designated 300, is illustrated. As shown in FIG. 29, a third embodiment of the connector plate 302 forms a generally square-like body 320 that defines a first side 330, a second side 332, a third side 334 and a fourth side 336. As shown, the connector plate 302 defines a first straight slot 326 formed in parallel orientation relative to the first side 330, a second straight slot 324 formed in parallel orientation relative to the second side 332, a third straight slot 328 formed in parallel orientation relative to the third side 336, and a fourth straight slot 332 formed in parallel orientation relative to the fourth side 334. In some embodiments, the connector plate 302 may define a central aperture 350 with respective curved slots 352 and 354 defined on both sides of the central aperture 350.

Figure 26:
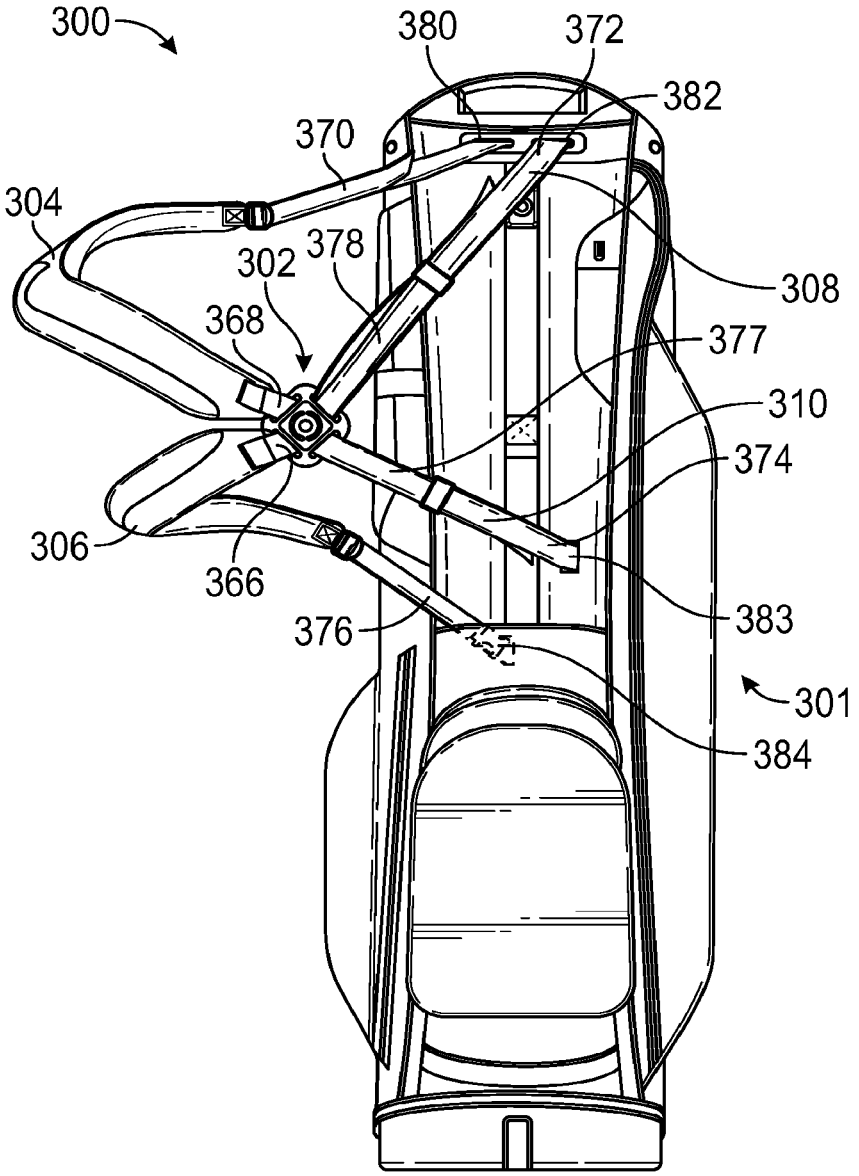
FIG. 26 is a front view of a golf bag with an adjustable carrying strap system coupled to a third embodiment of the connector plate of FIG. 29, according to aspects of the present disclosure;'

As shown in FIGS. 26-28, the adjustable carrying strap system 300 is coupled to a golf bag 301 through a first carrying strap 304, a second carrying strap 306, a third carrying strap 308 and a fourth carrying strap 310. Specifically, the first carrying strap 304 defines a proximal portion 370 coupled to the golf bag 301 through a first slot 380 and a distal portion 368 coupled to the connector plate 302 in a loop configuration through the first straight slot 326. As shown, the second carrying strap 306 defines a proximal portion 376 coupled to a quick-release buckle clip arrangement 384 (shown in phantom) attached to the golf bag 301, or alternatively sewn directly to the body of the golf bag 301, and a distal portion 366 coupled to the connector plate 302 in a loop configuration through the second straight slot 322. The third carrying strap 308 defines a proximal portion 372 coupled to the golf bag 301 through a second slot 382 and a distal portion 378 coupled to the connector plate 302 through the straight slot 324. In some embodiments, the fourth carrying strap 310 defines a distal portion 377 coupled to the connector plate 302 in a loop configuration through the fourth straight slot 328 and a proximal portion 374 inserted through the third slot 383 for operative engagement with a pair of deployable legs (not shown) attached to the golf bag 301 which are retracted by movement of the fourth carrying strap 310 when lifted upward onto the shoulder of the individual carrying the golf bag 301.

In some embodiments, a free end of the distal portion 378 of the third carrying strap 308 can be sewn to the remainder of the distal portion 378. In other embodiments, the free end of the distal portion 378 of the third carrying strap 308 can be coupled to the remainder of the distal portion 378 using a clasp, an adhesive, or any other suitable mechanism. Further, in some embodiments, a free end of the distal portion 377 of the fourth carrying strap 310 can be sewn to the remainder of the distal portion 377. In other embodiments, the free end of the distal portion 377 of the fourth carrying strap 310 can be coupled to the remainder of the distal portion 377 using a clasp, an adhesive, or any other suitable mechanism.

In some embodiments, the free ends of the proximal portions 370 and 372 may be configured in overlapping fashion to allow passage through the respective first and second slots 380 and 382 in a first orientation (e.g., parallel orientation relative to the respective slots 380 and 382), while preventing passage of the free ends of the proximal portions 370 and 372 back through the respective first and second slots 380 and 382 when the free ends are in a second orientation (e.g., perpendicular orientation relative to the respective slots 380 and 382). In this arrangement, the proximal portions 370 and 372 establish a secure engagement with the body of the golf bag 301.

The arrangement of the first carrying strap 304, the second carrying strap 306, the third carrying strap 308, and the fourth carrying strap 310 coupled to the connector plate 102 as described above provides a self-centering function for the golf bag 301 when mounted onto the shoulders of the individual.

In some embodiments, the connector plate 302 may have a length 718 of 63 mm and a height 720 of 63 mm, while the first, second, third, and fourth slots 322, 324, 326 and 328 each have a length 722 of 26 mm.

In same embodiments, the bags 101, 201 and 301 may be able to carry or transport weighted objects. The weighted objects may be any item that can fit into the bags 101, 201 and 301 including, but not limited to, golf clubs including iron-type golf clubs, wood-type golf clubs, and putter-type golf clubs, books, supplies, clothes, carpentry tools, architect tools, bowling ball, survey tools, computers and computer related accessories, papers, documents, art supplies, weapons, shoes, and food supplies. The bags 101, 201 and 301 may be in any configuration or shape as long as it is connected to the adjustable carrying strap systems 100, 200 and 300. In some embodiments, the bags 101, 201 and 301 may be generally a golf bag, an elongated duffle bag, a backpack, a bowling bag, a backpack, a computer bag, a rucksack, or a suitcase.

In addition, the bags 101, 201 and 301 may be made from a variety of materials, such as leather, synthetic rubber, neoprene, polyethylene, polyurethane, acrylonitrile butadiene styrene, plastic, fabric material, or combinations thereof. In addition, the carrying straps 104/106/105, 204/206/208/209, and 304/306/308/310 may also be made from a variety of materials, such as leather, synthetic rubber, neoprene, polyethylene, polyurethane, acrylonitrile butadiene styrene, plastic, fabric material, or combinations thereof. The apparatus, articles of manufacture, and methods described herein are not limited in this regard.

Clause 1: A connector plate comprising a connector plate body comprising a front surface and a rear surface defined opposite the front surface, the front and rear surfaces collectively defining an upper region and a lower region. The connector plate further comprising a first slot defined proximate a first side of the upper region, a second slot defined proximate a second side of the upper region opposite the first side of the upper region, a third slot defined proximate a first side of the lower region, and a fourth slot defined proximate a second side of the lower region opposite the first side of the lower region. The first slot, second slot, third slot, and fourth slot are configured to receive a first carrying strap, a second carrying strap, a third carrying strap, and a fourth carrying strap respectively.

Clause 2: The connector plate of clause 1, wherein the first slot has an arcuate configuration and is defined proximate the side of the first side of the upper region; the second slot has an arcuate configuration and is defined proximate the second side of the upper region; the third slot is a straight slot defined proximate the first side of the lower region; the fourth slot is a straight slot defined proximate the second side of the lower region; the first side and the second side of the upper region are curved; and the first side of the upper region is conjoined with the second side of the upper region to form a continuous arcuate shape.

Clause 3: The connector plate of clause 1, wherein the first slot is a straight slot defined proximate the first side of the upper region; the second slot is a straight slot defined proximate the second side of the upper region; the third slot is a straight slot defined proximate the first side of the lower region; the fourth slot is a straight slot defined proximate the second side of the lower region; the first side of the upper region is opposite the second side of the lower region, and the second side of the upper region is opposite the first side of the lower region; the first slot is formed in parallel orientation relative to the first side of the upper region, the second slot is formed in parallel orientation relative to the second side of the upper region, the third slot is formed in parallel orientation relative to the first side of the lower region, and the fourth slot is formed in parallel orientation relative to the second side of the lower region.

Clause 4: The connector plate of clause 1, wherein the upper region forms an upper half of the connector plate body and the lower region forms a lower half of the connector plate body.

Clause 5: The connector plate of clause 1, wherein a center slot is defined between the upper region adjacent the lower region.

Clause 6: The connector plate of clause 5, wherein the first slot, the center slot and fourth slot are aligned along a first axis and wherein the third slot and the second slot are aligned along a second axis.

Clause 7: The connector plate of clause 6, wherein the first axis is in transverse relation relative to the second axis.

Clause 8: The connector plate of clause 2, wherein the first slot is in alignment with the second slot.

Clause 9: The connector plate of clause 2, further comprising a bridge defined between the first slot and the second slot.

Clause 10: The connector plate of clause 3, wherein the third slot is in perpendicular relation relative to the fourth slot.

Clause 11: The connector plate of clause 1, wherein the first slot and the second slot each have respective lengths greater than each respective lengths of the third slot and the fourth slot.

Clause 12: The connector plate of clause 5, wherein the center slot is defined between the first and second arc slots and the first and second straight slots.

Clause 13: The connector plate of clause 5, wherein a center slot is defined between the upper region and the adjacent lower region, and the center slot is configured to receive a carrying strap.

Clause 14: A carrying strap system for a golf bag comprising a plurality of carrying straps comprising a first carrying strap, a second carrying strap, a third carrying strap, a fourth carrying strap. The carrying strap system further comprising a connector plate comprising a connector plate body engaged to the first carrying strap, the second carrying strap, the third carrying strap, and the forth carrying strap. The connector plate further comprising a front surface, a rear surface formed opposite the front surface, the front surface and the rear surface collectively defining a first side, a second side, a third side and a fourth side, wherein the first side is formed opposite the third side, and wherein the second side is formed opposite the fourth side, and a first slot, a second slot, a third slot, and a fourth slot collectively formed by the front surface and rear surface. The connector plate embodiment wherein the first slot is formed in parallel orientation relative to the first side, the second slot is formed in parallel orientation relative to the second side, the third slot is formed in parallel orientation relative to the third side, and the fourth slot is formed in parallel orientation relative to the fourth side.

Clause 15: The carrying strap system of clause 14, comprising the connector plate wherein the first slot and second slot are in an upper region of the connector plate body, and the third slot and the fourth slot are in a lower region of the connector plate body, the first side and the second side of the upper region are curved; and the first side of the upper region is conjoined with the second side of the upper region to form a continuous arcuate shape.

Clause 16: The carrying strap system of clause 15, comprising the connector plate wherein, the first slot has an arcuate configuration and is defined proximate the side of the first side of the upper region, the second slot has an arcuate configuration and is defined proximate the second side of the upper region, the third slot is a straight slot defined proximate the first side of the lower region, and the fourth slot is a straight slot defined proximate the second side of the lower region.

Clause 17: The carrying strap system of clause 14, comprising the connector plate wherein, the first slot is formed in parallel orientation relative to the first side of the upper region, the second slot is formed in parallel orientation relative to the second side of the upper region, the third slot is formed in parallel orientation relative to the first side of the lower region, and the fourth slot is formed in parallel orientation relative to the second side of the lower region, and the first side of the upper region is opposite the second side of the lower region, and the second side of the upper region is opposite the first side of the lower region.

Clause 18: The carrying strap system of clause 17, comprising the connector plate wherein the first slot is a straight slot defined proximate the first side of the upper region, the second slot is a straight slot defined proximate the second side of the upper region, the third slot is a straight slot defined proximate the first side of the lower region, and the fourth slot is a straight slot defined proximate the second side of the lower region.

Clause 19: The carrying strap system of clause 14, wherein the first carrying strap is coupled to the first slot in a loop configuration, the second carrying strap is coupled to the second slot in a loop configuration, the third carrying strap is coupled to the third slot in a loop configuration, and the fourth carrying strap is coupled to the fourth slot in a loop configuration.

Clause 20: A bag comprising an elongated body having a first upper portion defining an opening in communication with a chamber configured to receive one or more golf clubs therein. The bag further comprising an adjustable carrying strap coupled to the bag, the adjustable carrying straps system comprising a first carrying strap, a second carrying strap, a third carrying strap, and a fourth carrying strap, each of the first carrying strap, second carrying strap, third carrying strap, and fourth carrying strap defining a respective proximal portion attached to the elongated body. The bag further comprising a connector plate engaged to a respective distal portion of the first carrying strap, the second carrying strap, the third carrying strap and the fourth carrying strap. The connector plate comprising a front surface, a rear surface formed opposite the front surface, the front surface and the rear surface collectively defining a first side, a second side, a third side and a fourth side, wherein the first side is formed opposite the third side, and wherein the second side is formed opposite the fourth side, and a first slot, a second slot, a third slot, and a fourth slot collectively formed by the front surface and rear surface. The connector plate embodiment wherein the first slot is formed in parallel orientation relative to the first side, the second slot is formed in parallel orientation relative to the second side, the third slot is formed in parallel orientation relative to the third side, and the fourth slot is formed in parallel orientation relative to the fourth side. The bag wherein the distal portion of the first carrying strap is coupled to the first slot in a loop configuration, the distal portion of the second carrying strap is coupled to the second slot in a loop configuration, the distal portion of the third carrying strap is coupled to the third slot in a loop configuration, and the distal portion of the fourth carrying strap is coupled to the fourth slot in a loop configuration.

It should be understood from the foregoing that, while particular embodiments have been illustrated and described, various modifications can be made without departing from the spirit and scope of the invention as will be apparent to those skilled in the art. Such changes and modifications are within the scope and teachings of this invention as defined in the claims appended hereto.

What is claimed is:

1. A connector plate comprising:

a connector plate body comprising a front surface and a rear surface defined opposite the front surface, the front and rear surfaces collectively defining an upper region and a lower region;

a first slot defined proximate a first side of the upper region;

a second slot defined proximate a second side of the upper region;

a third slot defined proximate a first side of the lower region;

a fourth slot defined proximate a second side of the lower region opposite the first side of the lower region;

a center slot defined between the first and second slots and between the third and fourth slots; and wherein the first slot, second slot, third slot, and fourth slot are configured to receive a first carrying strap and a second carrying strap;

wherein the first slot has an arcuate configuration and is defined proximate the first side of the upper region;

the second slot has an arcuate configuration and is defined proximate the second side of the upper region;

the third slot is a straight slot defined proximate the first side of the lower region;

the fourth slot is a straight slot defined proximate the second side of the lower region;

the first side and the second side of the upper region are curved; and the first side of the upper region is conjoined with the second side of the upper region to form a continuous arcuate shape;

wherein the first side of the lower region and the second side of the lower region are straight; and wherein the first side of the lower region is conjoined to the first side of the upper region and an apex region, and the second side of the lower region is conjoined to the second side of the upper region and the apex region; and wherein the first slot and the second slot each have respective lengths greater than each respective lengths of the third slot and the fourth slot;

wherein the first strap is received through the third slot and received through the second slot;

wherein the second strap is received through the fourth slot, extends through the center slot, and is received through the first slot.

2. The connector plate of claim 1, wherein the upper region forms an upper half of the connector plate body and the lower region forms a lower half of the connector plate body.

3. The connector plate of claim 1, wherein the first slot and fourth slot are aligned along a first axis and wherein the third slot and the second slot are aligned along a second axis.

4. The connector plate of claim 3, wherein the first axis is in transverse relation relative to the second axis.

5. The connector plate of claim 1, wherein the first slot is in alignment with the second slot.

6. The connector plate of claim 1, further comprising: a bridge defined between the first slot and the second slot.

7. The connector plate of claim 1, wherein the first strap is received through the third slot such than the first strap is proximate the connector plate rear surface after the first strap passes through the third slot, and the first strap is proximate the connector plate front surface after the first strap is received through the second slot.

8. The connector plate of claim 1, wherein the second strap is received through the fourth slot such that the second strap is proximate the connector plate front surface, and such that when the second strap is received through the center slot the second strap is proximate the connector plate rear surface.

9. A carrying strap system for a golf bag comprising:

a plurality of carrying straps comprising:

a first carrying strap and a second carrying strap;

a connector plate comprising a connector plate body engaged to the first carrying strap and the second carrying strap;

the connector plate comprising:

a front surface; a rear surface formed opposite the front surface, the front surface and the rear surface collectively defining an upper region and a lower region;

wherein a first side of the upper region is formed opposite a second side of the lower region, and wherein a second side of the upper region is formed opposite a first side of the lower region;

and a first slot, a second slot, a third slot, a fourth slot, and a center slot collectively formed by the front surface and rear surface;

wherein the first slot has an arcuate configuration and is defined proximate the first side of the upper region;

wherein the second slot has an arcuate configuration and is defined proximate the second side of the upper region;

wherein the third slot is a straight slot defined proximate the first side of the lower region; and wherein the fourth slot is a straight slot defined proximate the second side of the lower region;

wherein the center slot is a straight slot between the first and second slots and between the third and fourth slots;

the first side and the second side of the upper region are curved;

the first side of the upper region is conjoined with the second side of the upper region to form a continuous arcuate shape;

wherein the first side of the lower region and the second side of the lower region are straight;

wherein the first side of the lower region is conjoined to the second side of the upper region and an apex region;

wherein the first slot and the second slot each have respective lengths greater than each respective lengths of the third slot and the fourth slot;

wherein the first slot is formed in parallel orientation relative to the first side of the upper region;

wherein the second slot is formed in parallel orientation relative to the second side of the upper region;

wherein the third slot is formed in parallel orientation relative to the first side of the lower region, and wherein the fourth slot is formed in parallel orientation relative to the second side of the lower region.

10. The carrying strap system of claim 9, comprising the connector plate wherein the first slot and second slot are in an upper region of the connector plate body.

11. The carrying strap system of claim 9, wherein the first slot, second slot, third slot, and fourth slot are configured to receive the first carrying strap and the second carrying strap;

wherein the first strap is received through the third slot and received through the second slot;

wherein the second strap is received through the fourth slot, extends through the center slot, and is received through the first slot.

12. A bag comprising:

an elongated body having a first upper portion defining an opening in communication with a chamber configured to receive one or more golf clubs therein;

an adjustable carrying strap system coupled to the bag;

the adjustable carrying strap system comprising:

a first carrying strap and a second carrying strap, and a connector plate;

the connector plate comprising:

a front surface;

a rear surface formed opposite the front surface, the front surface and the rear surface collectively defining an upper region and a lower region;

wherein a first side of the upper region is formed opposite a second side of the lower region; and wherein a second side of the upper region is formed opposite first side of the lower region;

wherein a first slot, a second slot, a third slot, a fourth slot, and a center slot are collectively formed by the front surface and rear surface;

wherein the first slot has an arcuate configuration and is defined proximate the first side of the upper region;

wherein the second slot has an arcuate configuration and is defined proximate the second side of the upper region;

wherein the third slot is a straight slot defined proximate the first side of the lower region;

wherein the fourth slot is a straight slot defined proximate the second side of the lower region;

wherein the center slot is a straight slot between the first and second slots and between the third and fourth slots;

wherein the first side and the second side of the upper region are curved;

wherein the first side of the upper region is conjoined with the second side of the upper region to form a continuous arcuate shape;

wherein the first side of the lower region and the second side of the lower region are straight;

wherein the first side of the lower region is conjoined to the first side of the upper region and an apex region;

wherein the second side of the lower region is conjoined to the second side of the upper region and the apex region;

wherein the first slot and the second slot each have respective lengths greater than each respective lengths of the third slot and the fourth slot;

wherein the first slot is formed in parallel orientation relative to the first side of the upper region, the second slot is formed in parallel orientation relative to the second side of the upper region, the third slot is formed in parallel orientation relative to the first side of the lower region, and the fourth slot is formed in parallel orientation relative to the second side of the lower region; and wherein the first strap is received through the third slot and received through the second slot;

wherein the second strap is received through the fourth slot, extends through the center slot, and is received through the first slot.

* * * * *